US010513963B2

(12) United States Patent
Koguchi et al.

(10) Patent No.: US 10,513,963 B2
(45) Date of Patent: Dec. 24, 2019

(54) ENGINE COOLING DEVICE

(71) Applicant: MAZDA MOTOR CORPORATION, Aki-gun, Hiroshima (JP)

(72) Inventors: Tomohiro Koguchi, Higashihiroshima (JP); Ryotaro Nishida, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 260 days.

(21) Appl. No.: 15/542,569

(22) PCT Filed: Jan. 15, 2016

(86) PCT No.: PCT/JP2016/000206
§ 371 (c)(1),
(2) Date: Jul. 10, 2017

(87) PCT Pub. No.: WO2016/121318
PCT Pub. Date: Aug. 4, 2016

(65) Prior Publication Data

US 2017/0370272 A1 Dec. 28, 2017

(30) Foreign Application Priority Data

Jan. 26, 2015 (JP) ..... 2015-012031

(51) Int. Cl.
*F01P 3/02* (2006.01)
*F01P 7/16* (2006.01)
(Continued)

(52) U.S. Cl.
CPC *F01P 3/02* (2013.01); *F01P 7/16* (2013.01); *F01P 11/16* (2013.01); *F02D 45/00* (2013.01); *F02F 1/36* (2013.01)

(58) Field of Classification Search
CPC ..... F01P 3/02; F01P 3/20; F01P 7/16; F01P 11/16; F02D 45/00; F02F 1/36
(Continued)

(56) References Cited

U.S. PATENT DOCUMENTS

2002/0112679 A1* 8/2002 Langervik ..... F01P 3/20 123/41.33
2003/0183701 A1* 10/2003 Takahashi ..... F01P 7/16 236/34.5
(Continued)

FOREIGN PATENT DOCUMENTS

JP 2011214566 A 10/2011

*Primary Examiner* — Joseph J Dallo
*Assistant Examiner* — Yi-Kai Wang
(74) *Attorney, Agent, or Firm* — Alleman Hall Creasman & Tuttle LLP

(57) ABSTRACT

An engine cooling device includes a heater circulation passage including an exhaust-side channel and a heater channel, the exhaust-side channel extending through an exhaust port-side portion of a cylinder head, the heater channel extending through a heater core; an auxiliary device circulation passage including a main channel and an auxiliary device channel, the main channel extending through a portion of the cylinder head other than the exhaust port-side portion, the auxiliary device channel extending through an auxiliary device; a temperature detecting portion configured to detect a temperature of an engine; and a channel switching valve configured to perform connection between the main channel and the auxiliary device channel and connection between the heater circulation passage and the auxiliary device circulation passage depending on the detected temperature falling within one of three temperature ranges.

13 Claims, 16 Drawing Sheets

(51) Int. Cl.
*F02D 45/00* (2006.01)
*F01P 11/16* (2006.01)
*F02F 1/36* (2006.01)

(58) Field of Classification Search
USPC ..... 123/41.08
See application file for complete search history.

(56) References Cited

U.S. PATENT DOCUMENTS

| | | | | |
|---|---|---|---|---|
| 2004/0060524 | A1* | 4/2004 | Hwang | F01P 3/02 123/41.28 |
| 2006/0005791 | A1* | 1/2006 | Obidi | F01P 3/02 123/41.29 |
| 2008/0168956 | A1* | 7/2008 | Lutz | F01P 3/02 123/41.1 |
| 2016/0123218 | A1* | 5/2016 | Lee | F01P 7/165 123/41.08 |
| 2016/0138530 | A1* | 5/2016 | Lee | F02M 26/22 123/568.12 |
| 2016/0146092 | A1* | 5/2016 | Lee | F01P 7/16 123/41.1 |
| 2017/0292435 | A1* | 10/2017 | Toyama | F01P 11/16 |
| 2018/0298806 | A1* | 10/2018 | Sutherland | F01P 7/14 |

* cited by examiner

ENGINE COOLING DEVICE

TECHNICAL FIELD

The present invention relates to an engine cooling device.

BACKGROUND ART

To promote warming-up of an engine, an engine cooling device configured to restrict circulation of cooling water during the warming-up has been known (see PTL 1, for example).

An engine cooling device described in PTL 1 includes: a cooling water pump configured to receive driving force of an engine to supply cooling water to a water jacket provided in an engine main body; an external passage through which the cooling water having flowed out from the water jacket is guided to a heater core and an EGR cooler to be returned to the cooling water pump; a flow control valve provided in the external passage; an exit water temperature sensor configured to detect a temperature of the cooling water flowing out from the water jacket to the external passage; and an entrance water temperature sensor configured to detect a temperature of the cooling water flowing from the external passage into the water jacket.

When the water temperature detected by the exit water temperature sensor at the time of warming-up of the engine is less than a predetermined temperature, the cooling device stops driving of the water pump to stop circulation of the cooling water in the external passage and the water jacket. When the water temperature detected by the exit water temperature sensor becomes the predetermined temperature or more, the cooling device drives the water pump to start the circulation of the cooling water. When starting the circulation of the cooling water, the cooling device performs a control operation of decreasing an opening degree of the flow control valve as the water temperature detected by the entrance water temperature sensor decreases.

According to the cooling device described in PTL 1, when starting the circulation of the cooling water, the low-temperature cooling water accumulated in the passage gradually flows into the water jacket by controlling the opening degree of the flow control valve. Therefore, a steep temperature decrease of a cylinder bore due to the flow of a large amount of low-temperature cooling water into the water jacket can be suppressed.

CITATION LIST

Patent Literature

PTL 1: Japanese Laid-Open Patent Application Publication No. 2011-214566

SUMMARY OF INVENTION

Technical Problem

To improve comfortability in a vehicle interior, it is required to quickly warm up a heater core of an air conditioner at the time of cold start of the engine. To quickly warm up the heater core, the engine cooling device may be configured as below.

To be specific, the cooling device includes: a heater channel through which the cooling water having been warmed up by the engine main body is guided to the heater core, and the cooling water which has released heat at the heater core is returned to the engine main body; and an auxiliary device channel through which the cooling water having flowed out from the engine main body is guided to auxiliary devices (such as an EGR cooler and an oil cooler), and the cooling water having flowed out from the auxiliary devices is returned to the engine main body. At the time of the cold start of the engine, first, the cooling water is supplied only to the heater channel. When the temperature of the cooling water increases to a predetermined temperature, the cooling water is supplied to both the heater channel and the auxiliary device channel while merging the cooling water in the heater channel and the cooling water in the auxiliary device channel.

By this configuration, the heater core can be quickly warmed up, and the vehicle interior can be quickly warmed.

However, if flow rate restriction of the auxiliary device channel is completely released when starting to supply the cooling water to the auxiliary device channel, a large amount of low-temperature cooling water in the auxiliary device channel flows into the heater channel. As a result, the temperature of the heater core decreases.

To avoid such trouble, as in PTL 1, there may be a case where the decrease in the temperature of the heater core due to the flow of a large amount of low-temperature cooling water of the auxiliary device channel into the engine main body is suppressed in such a manner that when starting to supply the cooling water to the auxiliary device channel, the flow rate of the cooling water supplied to the auxiliary device channel is restricted to a low flow rate.

However, if the flow rate of the cooling water supplied to the auxiliary device channel is restricted to a low flow rate, a problem is that cooling performance with respect to the engine main body and the auxiliary devices decreases.

The present invention was made in consideration of the above circumstances, and an object of the present invention is to provide an engine cooling device capable of suppressing a decrease in cooling performance with respect to an auxiliary device while promoting warming-up of a heater core.

Solution to Problem

To solve the above problems, the present invention provides an engine cooling device including: a heater circulation passage in which cooling water circulates, the heater circulation passage including an exhaust-side channel and a heater channel, the exhaust-side channel extending through an exhaust port-side portion of a cylinder head, the heater channel being connected to the exhaust-side channel and extending through a heater core of an air conditioner; an auxiliary device circulation passage in which the cooling water circulates, the auxiliary device circulation passage including a main channel and an auxiliary device channel, the main channel extending through a portion of the cylinder head other than the exhaust port-side portion, the auxiliary device channel being connected to the main channel and extending through an auxiliary device; a heater pump provided at the heater circulation passage and configured to circulate the cooling water in the heater circulation passage; an auxiliary device pump provided at the auxiliary device circulation passage and configured to circulate the cooling water in the auxiliary device circulation passage; a channel switching valve configured to perform connection and disconnection between the main channel and the auxiliary device channel and connection and disconnection between the heater circulation passage and the auxiliary device circulation passage; and a control portion configured to control an operation of the channel switching valve based on a temperature of the engine, wherein: during warming-up of the engine, the control portion performs such control operations that (i) when the temperature of the engine falls within a first temperature range, the main channel and the auxiliary device channel are not connected to each other, (ii) when the temperature detected by the temperature detecting portion falls within a second temperature range higher than the first temperature range, the main channel and the auxiliary device channel are connected to each other, and the heater circulation passage and the auxiliary device circulation passage are not connected to each other, and (iii) when the temperature of the engine falls within a third temperature range higher than the second temperature range, the main channel and the auxiliary device channel are connected to each other, and the heater circulation passage and the auxiliary device circulation passage are connected to each other.

According to the present invention, the control operation (ii) of supplying the cooling water individually to the heater circulation passage and the auxiliary device circulation passage which are not connected to each other is set between the control operation (i) of supplying the cooling water only to the heater circulation passage and the control operation (iii) of supplying the cooling water to the entire heater circulation passage and the entire auxiliary device circulation passage which are connected to each other. Therefore, the decrease in the cooling performance with respect to the engine main body and the auxiliary device can be suppressed while promoting the warming-up of the heater core.

To be specific, since a high-temperature exhaust gas flows through an exhaust port, the cooling water flowing through the exhaust-side channel is warmed up more quickly than the cooling water flowing through the main channel and is made higher in temperature than the cooling water flowing through the main channel. In each of the control operations (i) to (iii), during the engine warming-up, the cooling water having flowed through the exhaust-side channel flows through the heater channel. Therefore, the warming-up of the heater core can be promoted.

At an initial stage of the warming-up, the auxiliary device is still in a low temperature state. Therefore, the necessity of cooling the auxiliary device at this stage is low. On this account, the warming-up of the heater core is promoted by performing the control operation (i) of circulating the cooling water only in the heater circulation passage. As the warming-up proceeds, the auxiliary device increases in temperature. Therefore, the auxiliary device is cooled by performing the control operation (ii) of circulating the cooling water in the auxiliary device circulation passage. At this time, the low-temperature cooling water in the auxiliary device channel flows into the main channel to absorb heat of the cylinder head, so that the cooling water increases in temperature. Further, by performing the control operation (ii) of circulating the cooling water in the heater circulation passage that is not connected to the auxiliary device circulation passage, that is, is provided independently from the auxiliary device circulation passage, the warming-up of the heater core can be performed while preventing the low-temperature cooling water in the auxiliary device channel from flowing into the heater channel. When the warming-up further proceeds, the control operation (iii) of connecting the auxiliary device circulation passage and the heater circulation passage and circulating the cooling water in the entire auxiliary device circulation passage and the entire heater circulation passage is performed. At a stage of shifting to the control operation (iii), the cooling water in the auxiliary device channel is already increased in temperature. Therefore, the decrease in the temperature of the heater core when the cooling water flows from the auxiliary device channel to the heater channel is suppressed. On this account, without restricting the flow rate of the cooling water in the auxiliary device circulation passage, the decrease in the temperature of the heater core can be suppressed, and the decrease in the cooling performance with respect to the auxiliary device can be suppressed.

In the present invention, it is preferable that: the engine cooling device further include a flow control valve configured to adjust a flow rate of the cooling water flowing through the auxiliary device channel; and the flow control valve restrict the flow rate of the cooling water to a low flow rate in a predetermined initial period after the main channel and the auxiliary device channel are connected to each other by the channel switching valve, and then gradually increase the flow rate of the cooling water to a predetermined flow rate.

According to this configuration, when connecting the main channel and the auxiliary device channel, the low-temperature cooling water in the auxiliary device channel gradually flows into the main channel. Therefore, a steep temperature decrease around combustion chambers can be suppressed.

In the present invention, it is preferable that: the auxiliary device circulation passage further include a radiator channel connected to the auxiliary device channel and extending through a radiator; the channel switching valve further perform connection and disconnection between the radiator channel and the auxiliary device channel; and the control portion connect the radiator channel with the auxiliary device channel when the temperature of the engine falls within a fourth temperature range higher than the third temperature range.

According to this configuration, the cooling water can be cooled by the radiator.

In the present invention, it is preferable that: the engine cooling device further include a flow control valve configured to adjust a flow rate of the cooling water flowing through the auxiliary device channel and a flow rate of the cooling water flowing through the radiator channel; the control portion further control an operation of the flow control valve based on the temperature of the engine and an engine load; and when the temperature of the engine falls within the fourth temperature range, the control portion perform a control operation of decreasing the flow rate of the cooling water flowing through the auxiliary device channel and increasing the flow rate of the cooling water flowing through the radiator channel as the engine load increases.

According to this configuration, as the engine load increases, the flow rate of the cooling water flowing through the radiator increases. Therefore, when the engine load is high, such as when a vehicle climbs a hill, a cooling function for the engine main body and the auxiliary device can be enhanced, so that the engine main body and the auxiliary device can operate appropriately.

In the present invention, it is preferable that: the control portion further control an operation of the heater pump based on the temperature of the engine and the engine load; and when the temperature of the engine falls within the fourth temperature range, the control portion perform a control operation of increasing an ejection amount of the heater pump as the engine load increases.

According to this configuration, as the engine load increases, the flow rate of the cooling water flowing through the radiator increases. Therefore, when the engine load is high, such as when a vehicle climbs a hill, the cooling function for the engine main body and the auxiliary device can be enhanced, so that the temperatures of the engine main body and the auxiliary device can be appropriately adjusted.

In the present invention, it is preferable that the channel switching valve include only a valve corresponding to the exhaust-side channel, a valve corresponding to the auxiliary device channel, and a valve corresponding to the radiator channel.

According to this configuration, by opening or closing the valve corresponding to the exhaust-side channel, the valve corresponding to the auxiliary device channel, and the valve corresponding to the radiator channel, the engine cooling device can be shifted to each of the stages of the control operations (i) to (iii) and the stage of cooling the cooling water by the radiator. Further, since the channel switching valve does not include a valve corresponding to the main channel, the configuration of the channel switching valve can be simplified.

In the present invention, it is preferable that the heater channel further extend through a throttle body configured to adjust an amount of intake air supplied to the cylinder head.

According to this configuration, the warming-up of the throttle body can be quickly performed. Therefore, even in a case where the throttle body is frozen at the time of the cold start of the engine, the throttle body can be quickly defrosted.

In the present invention, it is preferable that: the channel switching valve further perform connection and disconnection between the main channel and the heater channel; and when the temperature of the engine falls within a high temperature-side temperature range of the first temperature range, the control portion perform such a control operation that the main channel and the auxiliary device channel are not connected to each other, and the main channel and the heater channel are connected to each other.

According to this configuration, heat is applied to the cooling water in the main channel and the exhaust-side channel. Therefore, the warming-up of the heater core can be further quickly performed.

In the present invention, it is preferable that the heater pump be an electric pump.

According to this configuration, since the electric pump is adopted, a necessary amount of cooling water can be caused to circulate when necessary without depending on the engine revolution speed. Thus, the flow rate of the cooling water can be appropriately adjusted. Further, since the electric pump can be driven without through a timing chain that transmits driving force of the engine, the number of parts can be reduced.

Advantageous Effects of Invention

As explained above, the present invention can suppress the decrease in the cooling performance with respect to the auxiliary device while promoting the warming-up of the heater core.

DESCRIPTION OF EMBODIMENTS

Hereinafter, a preferred embodiment of the present invention will be explained in detail in reference to the attached drawings.

Figure 1:
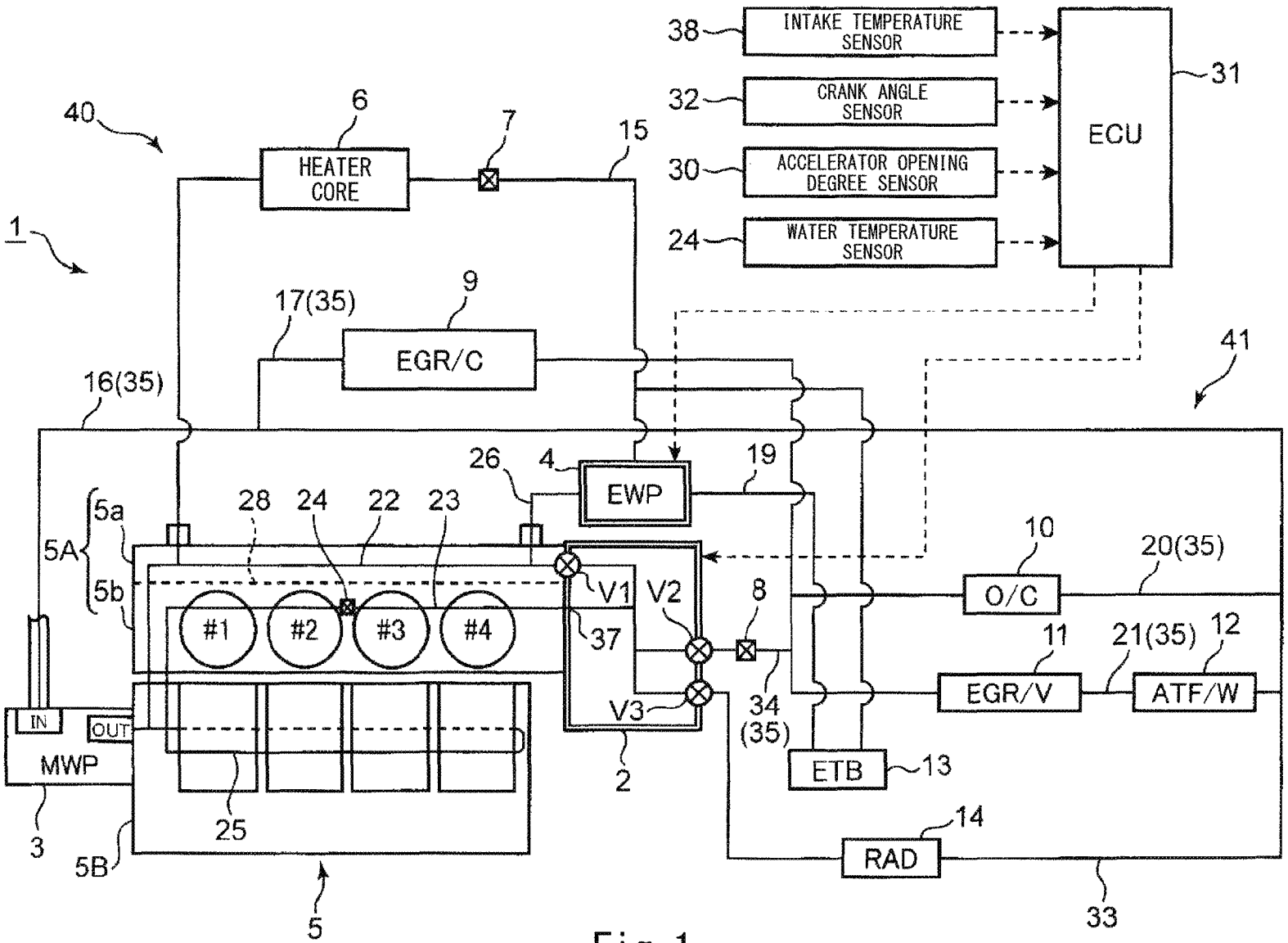
FIG. 1 is a block diagram showing an entire configuration of an engine cooling device according to an embodiment of the present invention and is a diagram showing a state (water stop state) where the flow of cooling water in the entire cooling device is stopped when a temperature of the cooling water is less than a temperature T0.

As shown in FIG. 1, an engine 5 of the present embodiment includes: a cylinder block 5B; and a cylinder head 5A provided at an upper side of the cylinder block 5B.

In FIG. 1, the cylinder head 5A is shown as a diagram when viewed from above, and the cylinder block 5B is shown as a diagram when viewed from an intake side.

In FIGS. 1, 3, 4, 6, 8, 10, and 12, a case where an arrow is shown in a cooling water channel indicates that the cooling water is flowing through the channel, and a case where an arrow is not shown in a channel indicates that the cooling water is not flowing through the channel.

A plurality of cylinders #1 to #4 in which respective pistons (not shown) are fittingly inserted are formed in the cylinder head 5A and the cylinder block 5B. Specifically, a first cylinder #1, a second cylinder #2, a third cylinder #3, and a fourth cylinder #4 are formed in this order from a left side in FIG. 1. The engine 5 is an inline four-cylinder engine in which these four cylinders #1 to #4 are lined up in series in a crank shaft direction. A below-described rotary valve device 2 is provided at an end portion of the cylinder head 5A, the end portion being located close to the fourth cylinder #4. The engine 5 is arranged in an engine room provided at a vehicle front portion.

Combustion chambers are formed above the respective pistons. Intake ports and exhaust ports (both not shown) that are open toward the combustion chambers are formed on the cylinder head 5A. In FIG. 1, the intake ports are located at a lower side of the cylinders #1 to #4, and the exhaust ports are located at an upper side of the cylinders #1 to #4. Intake air is introduced through the intake ports to the cylinders, and an exhaust gas is discharged from the cylinders through the exhaust ports.

An exhaust-side water jacket and a main water jacket are formed at the cylinder head 5A. The exhaust-side water jacket extends through an exhaust port-side portion of the cylinder head 5A in a cylinder column direction from the first cylinder #1 to the fourth cylinder #4. The main water jacket extends through portions of the cylinder head 5A other than the exhaust port-side portion, that is, portions around the combustion chambers and an intake port-side portion in the cylinder column direction from the first cylinder #1 to the fourth cylinder #4.

The exhaust-side water jacket corresponds to a below-described exhaust-side channel 22 (see FIG. 1). The main water jacket corresponds to a below-described main channel 23 (see FIG. 1). A dividing wall 28 is provided between the exhaust-side water jacket (exhaust-side channel 22) and the main water jacket (main channel 23). The exhaust-side water jacket and the main water jacket are formed so as to be separated from each other by the dividing wall 28.

The cylinder block 5B includes a main water jacket provided around the cylinders #1 to #4. The main water jacket extends through the cylinder block 5B so as to start from the first cylinder #1, make a U-turn at the fourth cylinder #4, and return to the first cylinder #1, that is, so as to circle the cylinder block 5B. The water jacket of the cylinder block 5B corresponds to a below-described block channel 25 (see FIG. 1).

Next, a cooling device 1 of the engine 5 will be explained in detail.

As shown in FIG. 1, the cooling device 1 includes a heater circulation passage 40, an auxiliary device circulation passage 41, water temperature sensors 7, 8, and 24, an accelerator opening degree sensor 30, a crank angle sensor 32, an intake temperature sensor 38, a heater pump 4, an auxiliary device pump 3, the rotary valve device 2, and an ECU 31 (Electronic Control Unit).

The heater pump 4 is an electronically controlled electric pump. The heater pump 4 includes one suction port and one discharge port. A downstream end portion of a below-described heater channel 15 is connected to the suction port. A branch pipe (not shown) that branches into two parts at a downstream side is connected to the discharge port. An upstream end portion of a below-described communication channel 26 (see FIG. 1) is connected to an end portion of one of two branched parts of the branch pipe, and an upstream end portion of a below-described ETB channel 19 (see FIG. 1) is connected to an end portion of the other branched part of the branch pipe.

The auxiliary device pump 3 is a mechanical pump and operates by receiving driving force of the engine.

Auxiliary devices of the present embodiment are an EGR (Exhaust Gas Recirculation) cooler 9, an oil cooler 10, an EGR valve 11, an ATF (Automatic Transmission Fluid) warmer 12, an electronically controlled throttle body (hereinafter referred to as "ETB") 13, and a radiator 14.

Configuration of Heater Circulation Passage 40

The heater circulation passage 40 (see FIG. 1) is a passage in which the cooling water circulates. The heater circulation passage 40 includes the exhaust-side channel 22, the heater channel 15, the ETB channel 19, and the communication channel 26.

The exhaust-side channel 22 is a passage extending through an exhaust port-side portion 5*a* of the cylinder head 5A. One end portion of the exhaust-side channel 22 is connected to the block channel 25, more specifically, to a portion of the block channel 25 which portion is located at an opposite side of the rotary valve device 2. The other end portion of the exhaust-side channel 22 is connected to the rotary valve device 2.

The heater channel 15 is a channel extending through a heater core 6 of an air conditioner. An upstream end portion of the heater channel 15 is connected to a portion of the exhaust-side channel 22, more specifically, to a portion of the exhaust-side channel 22 which portion is located at an opposite side of the rotary valve device 2. The water temperature sensor 7 configured to detect a temperature of the cooling water is provided at the heater channel 15 so as to be located downstream of the heater core 6.

The ETB channel 19 is a channel extending through the ETB 13. A downstream end portion of the ETB channel 19 is connected to a section of the heater channel 15 which section is located between the heater core 6 and the heater pump 4.

The communication channel 26 is a channel through which the discharge port of the heater pump 4 and the exhaust-side channel 22 communicate with each other. A downstream end portion of the communication channel 26 is connected to a portion of the exhaust-side channel 22 which portion is located near the rotary valve device 2.

Configuration of Rotary Valve Device 2

Figure 2A:
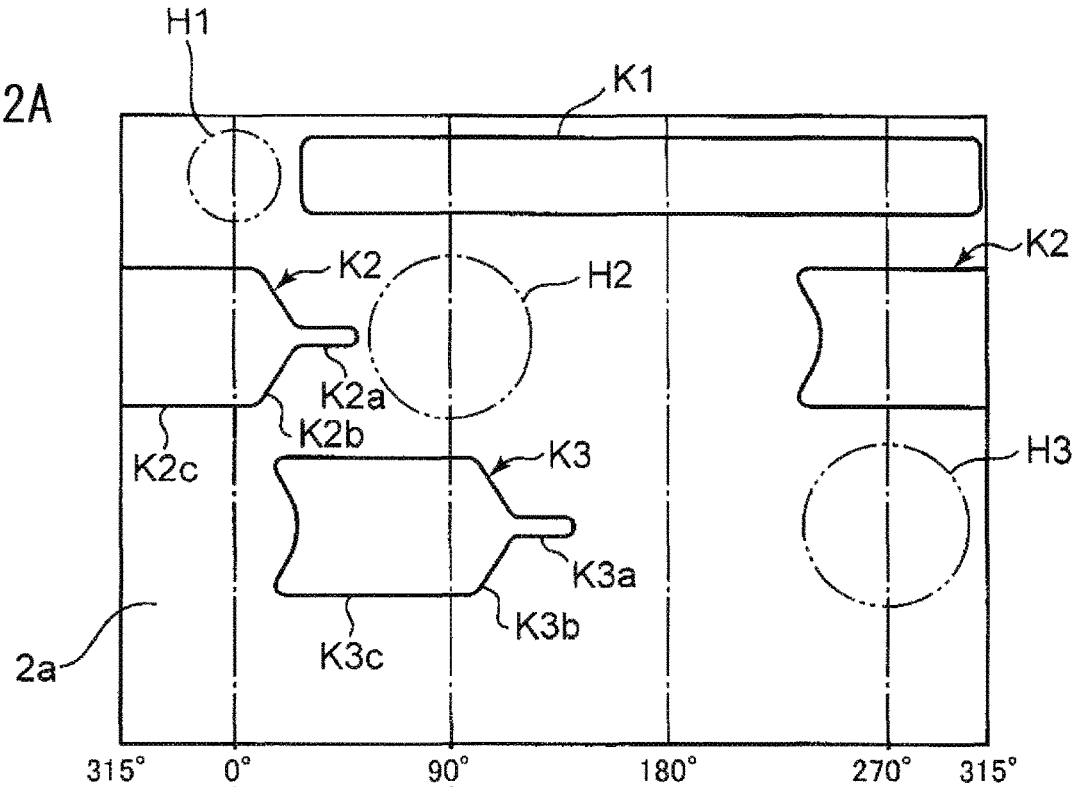
FIG. 2A is a development view showing a peripheral wall of a rotary valve in a control state shown in FIG. 1.
Figure 2B:
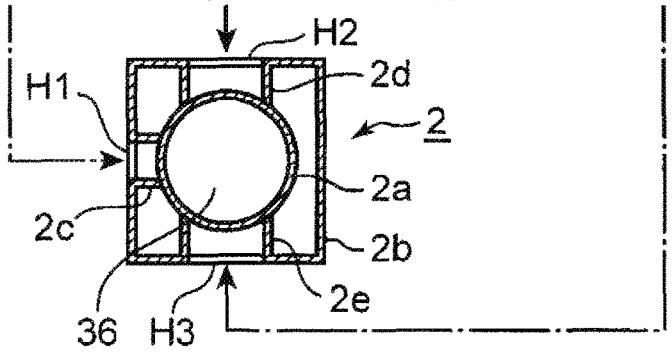
FIG. 2B is a diagram showing positions of opening portions provided at a housing surrounding the rotary valve.

As shown in FIG. 2B, the rotary valve device 2 includes: a cylindrical rotary valve 2*a*; a rectangular solid-shaped housing 2*b* accommodating the rotary valve 2*a*; and an electronically controlled electric motor (not shown) configured to rotate the rotary valve 2*a*. The rotary valve 2*a* is rotatable in a circumferential direction (direction around an axis) in the housing 2*b*.

As shown in FIG. 2B, the housing 2*b* includes: opening portions H1, H2, and H3; and an opening portion not shown (hereinafter referred to as a "not-shown opening portion"). The opening portion H1 is formed on a surface (left side surface in FIG. 2B) of the housing 2*b* which surface is located close to the engine 5. The opening portion H2 is formed on an upper surface (upper side surface in FIG. 2B) of the housing 2*b*. The opening portion H3 is formed on a lower side surface (lower side surface in FIG. 2B) of the housing 2*b*. The opening portions H1, H2, and H3 are holes through which the cooling water flows.

A cylindrical lip portion 2*c* extending from an inner peripheral edge of the opening portion H1 toward the rotary valve 2*a* is provided between the opening portion H1 and the rotary valve 2*a*. An end portion of the lip portion 2*c* which portion is located close to the opening portion H1 is fixed to the inner peripheral edge of the opening portion H1. The lip portion 2*c* is formed separately from the rotary valve 2*a* and is not fixed to the rotary valve 2*a*. An end surface of the lip portion 2*c* which surface is located close to the rotary valve 2*a* has a shape formed along an outer peripheral surface of the rotary valve 2*a*. With this, the end surface of the lip portion 2*c* which surface is located close to the rotary valve 2*a* can slidingly contact the outer peripheral surface of the rotary valve 2*a*.

A lip portion 2*d* similar to the lip portion 2*c* is provided between the opening portion H2 and the rotary valve 2*a*. Further, a lip portion 2*e* similar to the lip portion 2*c* is provided between the opening portion H3 and the rotary valve 2*a*.

As shown in FIG. 2A, the rotary valve 2*a* includes cutout holes K1, K2, and K3 on a peripheral wall thereof. An opening portion 36 (see FIG. 2B) is formed at an axial direction end portion of the rotary valve 2*a*.

FIG. 2A is a development view of the rotary valve 2*a* and shows positions on the peripheral surface of the rotary valve 2*a* based on 0° to 360° that are angles around a center axis of the rotary valve 2*a*. An upward/downward direction in FIG. 2A is an axial direction of the rotary valve 2*a*, and a leftward/rightward direction in FIG. 2A is a circumferential direction of the rotary valve 2*a*. To show positional relations among the opening portions H1, H2, and H3 and the cutout holes K1, K2, and K3, the opening portions H1, H2, and H3 are shown by two-dot chain lines in FIG. 2A. As shown in FIG. 2A, a center of the opening portion H1 is located at a reference position 0° at all times.

As shown in FIG. 2A, the cutout holes K1, K2, and K3 are lined up in this order from one axial direction end of the rotary valve 2*a* to the other axial direction end.

As the rotary valve 2*a* rotates, the positions of the cutout holes K1, K2, and K3 change in the circumferential direction (leftward/rightward direction in FIG. 2A).

The cutout hole K1 has a rectangular shape extending in the circumferential direction of the rotary valve 2*a*. At a certain point of time in FIG. 2A (i.e., when the flow of the cooling water is stopped in the entire cooling device 1), the cutout hole K1 extends from about 30° to about 315°.

The cutout hole K2 includes: a rectangular main portion K2*c* extending in the circumferential direction of the rotary valve 2*a* and having one longitudinal direction end portion (left end portion in FIG. 2A) that is concave; a tapered portion K2*b* provided continuously with the other longitudinal direction end portion (right end portion in FIG. 2A) of the main portion K2*c* and having a triangular shape; and a projecting portion K2*a* projecting from a tip end of the tapered portion K2*b*. At the certain point of time in FIG. 2A, the cutout hole K2 extends from about 230° to about 45°. A width (length in the axial direction of the rotary valve 2*a*) of the main portion K2*a* of the cutout hole K2 is larger than a width of the cutout hole K1.

The cutout hole K3 includes: a rectangular main portion K3*c* extending in the circumferential direction of the rotary valve 2*a* and having one longitudinal direction end portion that is concave; a tapered portion K3*b* provided continuously with the other longitudinal direction end portion of the main portion K3*c* and having a triangular shape; and a projecting portion K3*a* projecting from a tip end of the tapered portion K3*b*. A length of the main portion K3*c* in the circumferential direction is shorter than a length of the main portion K2*c* of the cutout hole K2 in the circumferential direction. At the certain point of time in FIG. 2A, the cutout hole K3 extends from about 15° to about 140°. A width of the main portion K3*c* of the cutout hole K3 is equal to the width of the main portion K2*c* of the cutout hole K2 and is larger than the width of the cutout hole K1.

The opening portion H1 is provided at such a position as to be able to overlap the cutout hole K1 in accordance with rotation of the rotary valve 2*a* and is provided such that a center thereof is located at 0° shown in FIG. 2A. A diameter of the opening portion H1 is slightly larger than the width of the cutout hole K1. The opening portion H1 is connected to an end portion of the exhaust-side channel 22 which portion is located close to the rotary valve device 2.

The opening portion H2 is provided at such a position as to be able to overlap the cutout hole K2 in accordance with the rotation of the rotary valve 2*a* and is provided such that a center thereof is located at 90° shown in FIG. 2A. A diameter of the opening portion H2 is slightly larger than the width of the cutout hole K2. The opening portion H2 is connected to an upstream channel 34 of a below-described auxiliary device channel 35.

The opening portion H3 is provided at such a position as to be able to overlap the cutout hole K3 in accordance with the rotation of the rotary valve 2*a* and is provided such that a center thereof is located at 270° shown in FIG. 2A. A diameter of the opening portion H3 is slightly larger than the width of the cutout hole K3. The opening portion H3 is connected to an upstream end portion of a below-described radiator channel 33.

In the rotary valve device 2, when the cutout hole K1 and the opening portion H1 overlap each other, the exhaust-side channel 22 and an inside of the rotary valve 2*a* communicate with each other. When the cutout hole K1 and the opening portion H1 do not overlap each other, the exhaust-side channel 22 and the inside of the rotary valve 2*a* do not communicate with each other (are blocked from each other). An overlapping area (communication area) between the cutout hole K1 and the opening portion H1 changes in accordance with the rotation of the rotary valve 2*a*. To be specific, the cutout hole K1 and the opening portion H1 constitute a flow control valve. In the following explanation, the flow control valve constituted by the cutout hole K1 and the opening portion H1 is referred to as a flow control valve V1.

Similarly, the cutout hole K2 and the opening portion H2 constitute a flow control valve. Further, the cutout hole K3 and the opening portion H3 constitute a flow control valve. In the following explanation, the flow control valve constituted by the cutout hole K2 and the opening portion H2 is referred to as a flow control valve V2, and the flow control valve constituted by the cutout hole K3 and the opening portion H3 is referred to as a flow control valve V3.

A gap is provided between the opening portion 36 (see FIG. 2B) of the axial direction end portion of the rotary valve 2*a* and an inner wall surface of the housing 2*b* which surface faces the opening portion 36. The above not-shown opening portion formed on the housing 2*b* communicates with the inside of the rotary valve 2*a* at all times through the gap and the cutout holes K1 to K3. This portion that communicates with the inside of the rotary valve 2*a* at all times is shown as a communication portion 37 in FIG. 1.

Figure 3:
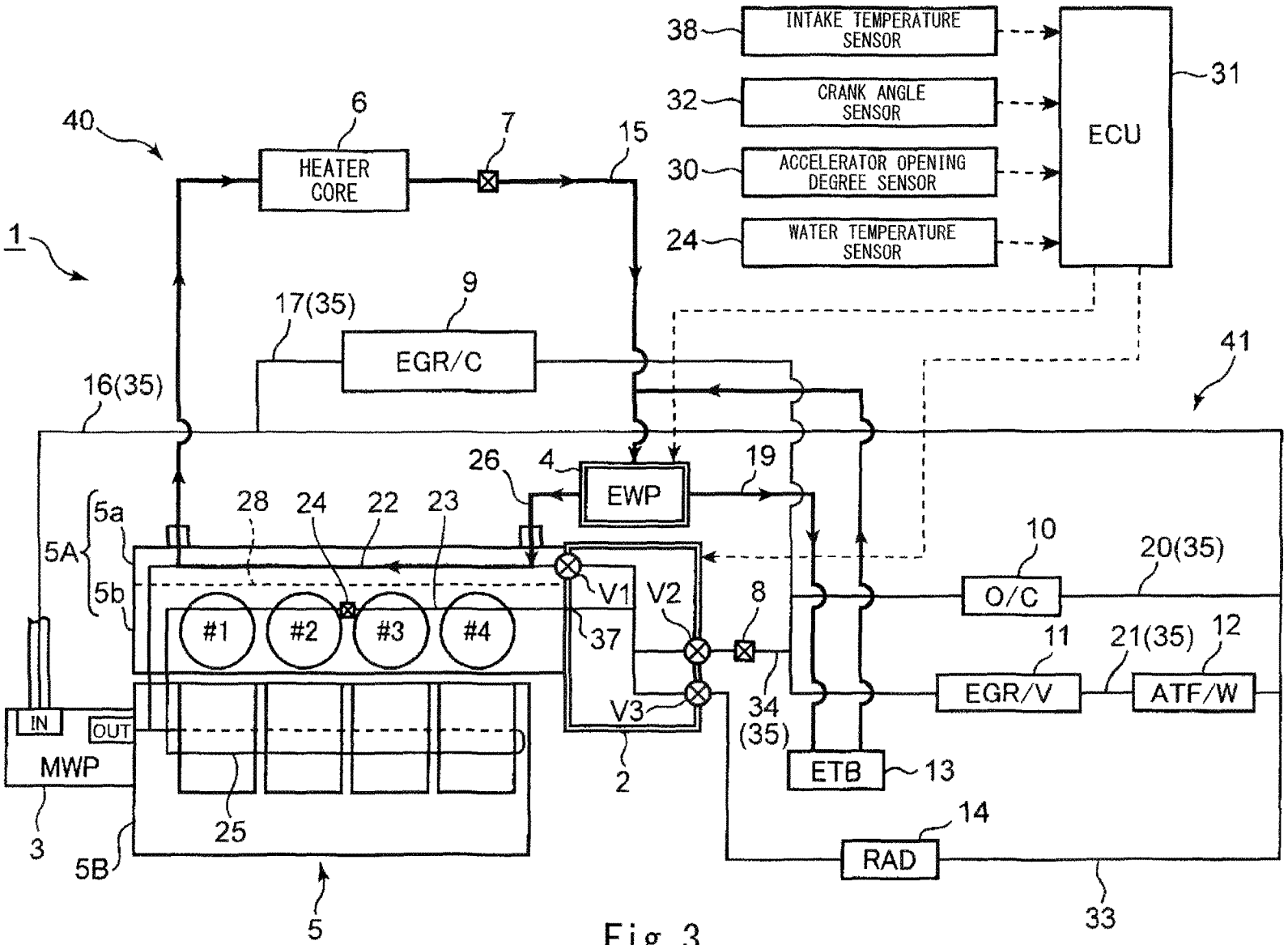
FIG. 3 is a block diagram showing an entire configuration of the engine cooling device according to the embodiment of the present invention and is a diagram showing a control state (control state A) when a combustion chamber wall temperature is the temperature T0 or more and less than a temperature T1.

In a case where all the flow control valves V1, V2, and V3 of the rotary valve device 2 are closed, the cooling water does not flow through the rotary valve device 2 (see FIGS. 1 and 3). To be specific, the cooling water does not flow in the rotary valve device 2.

Figure 4:
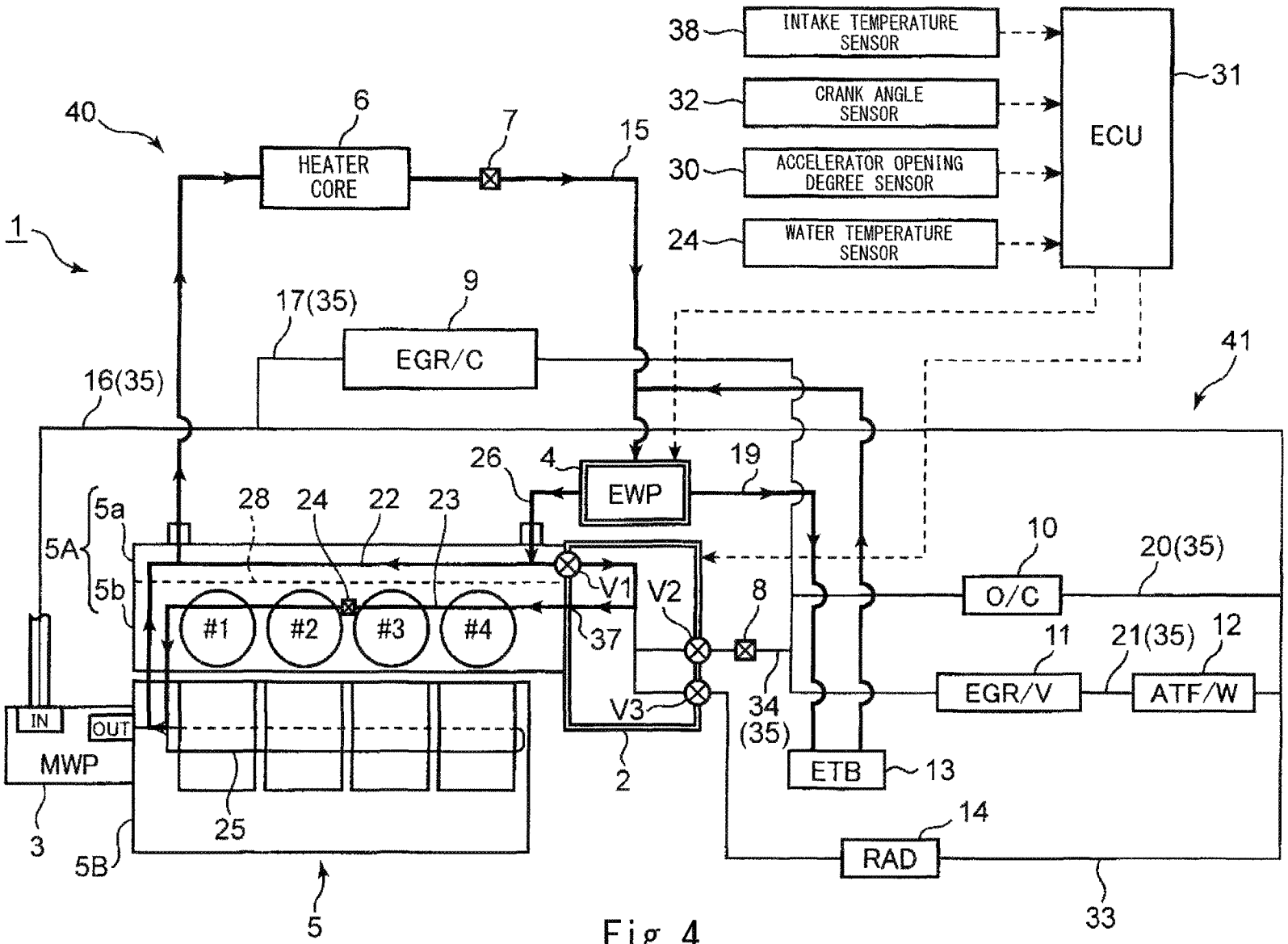
FIG. 4 is a block diagram showing an entire configuration of the engine cooling device according to the embodiment of the present invention and is a diagram showing a control state (control state B) when the combustion chamber wall temperature is the temperature T1 or more and less than a temperature T2.

In a case where only the flow control valve V1 is open, the cooling water flows between the exhaust-side channel 22 and the main channel 23 through the rotary valve device 2 (see FIG. 4). To be specific, a channel connecting the exhaust-side channel 22 and the main channel 23 is formed in the rotary valve device 2.

Figure 6:
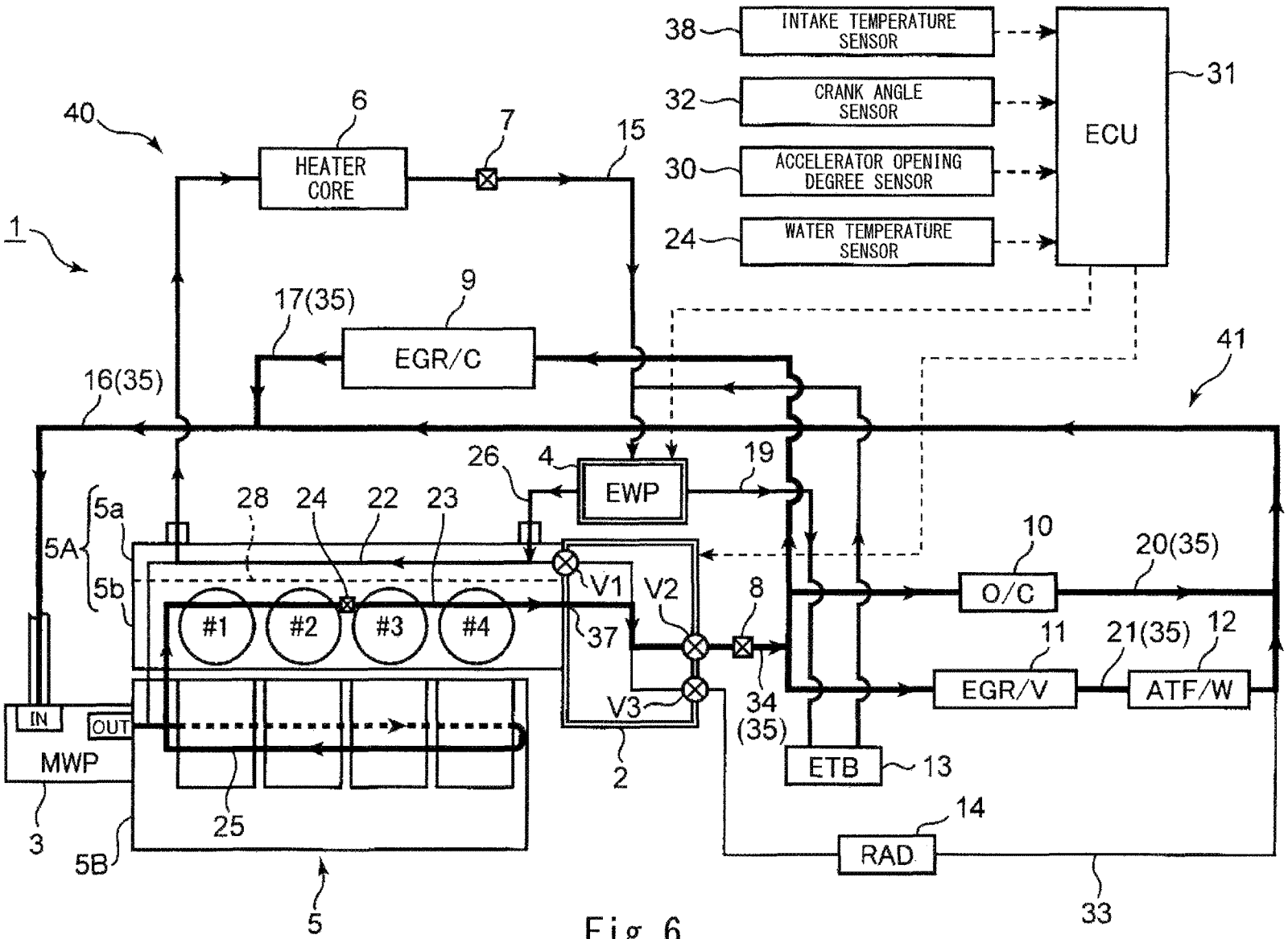
FIG. 6 is a block diagram showing an entire configuration of the engine cooling device according to the embodiment of the present invention and is a diagram showing a control state (control state C) when the combustion chamber wall temperature is the temperature T2 or more and less than a temperature T3.

In a case where only the flow control valve V2 is open, the cooling water flows between the auxiliary device channel 35 and the main channel 23 through the rotary valve device 2 (see FIG. 6). To be specific, a channel connecting the auxiliary device channel 35 and the main channel 23 is formed in the rotary valve device 2.

Figure 8:
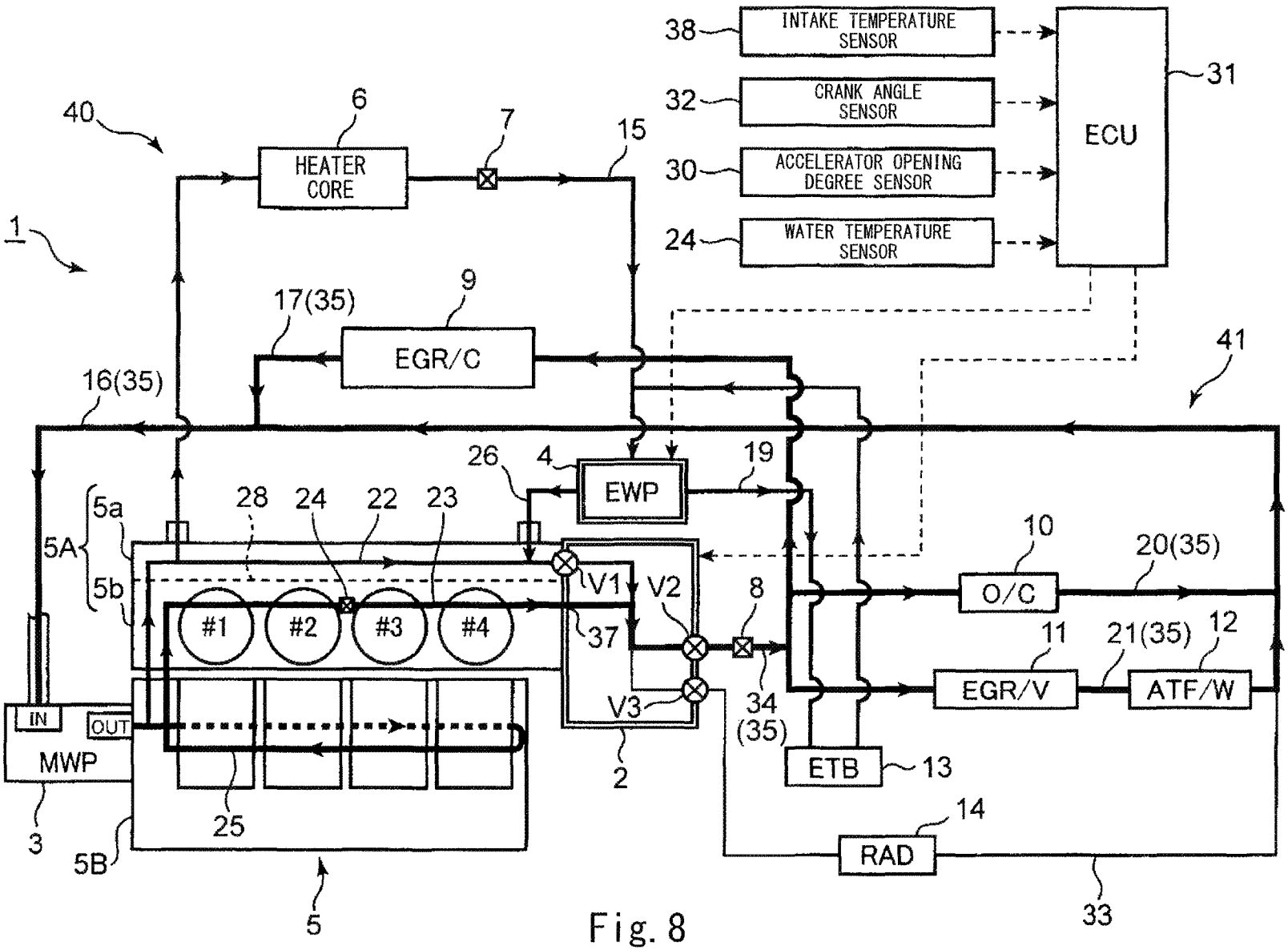
FIG. 8 is a block diagram showing an entire configuration of the engine cooling device according to the embodiment of the present invention and is a diagram showing a control state (control state D) when the combustion chamber wall temperature is the temperature T3 or more and less than a temperature T4.

In a case where only the flow control valves V1 and V2 are open, the cooling water flows among the exhaust-side channel 22, the main channel 23, and the auxiliary device channel 35 through the rotary valve device 2 (see FIG. 8). To be specific, a channel connecting the exhaust-side channel 22, the main channel 23, and the auxiliary device channel 35 is formed in the rotary valve device 2.

Figure 10:
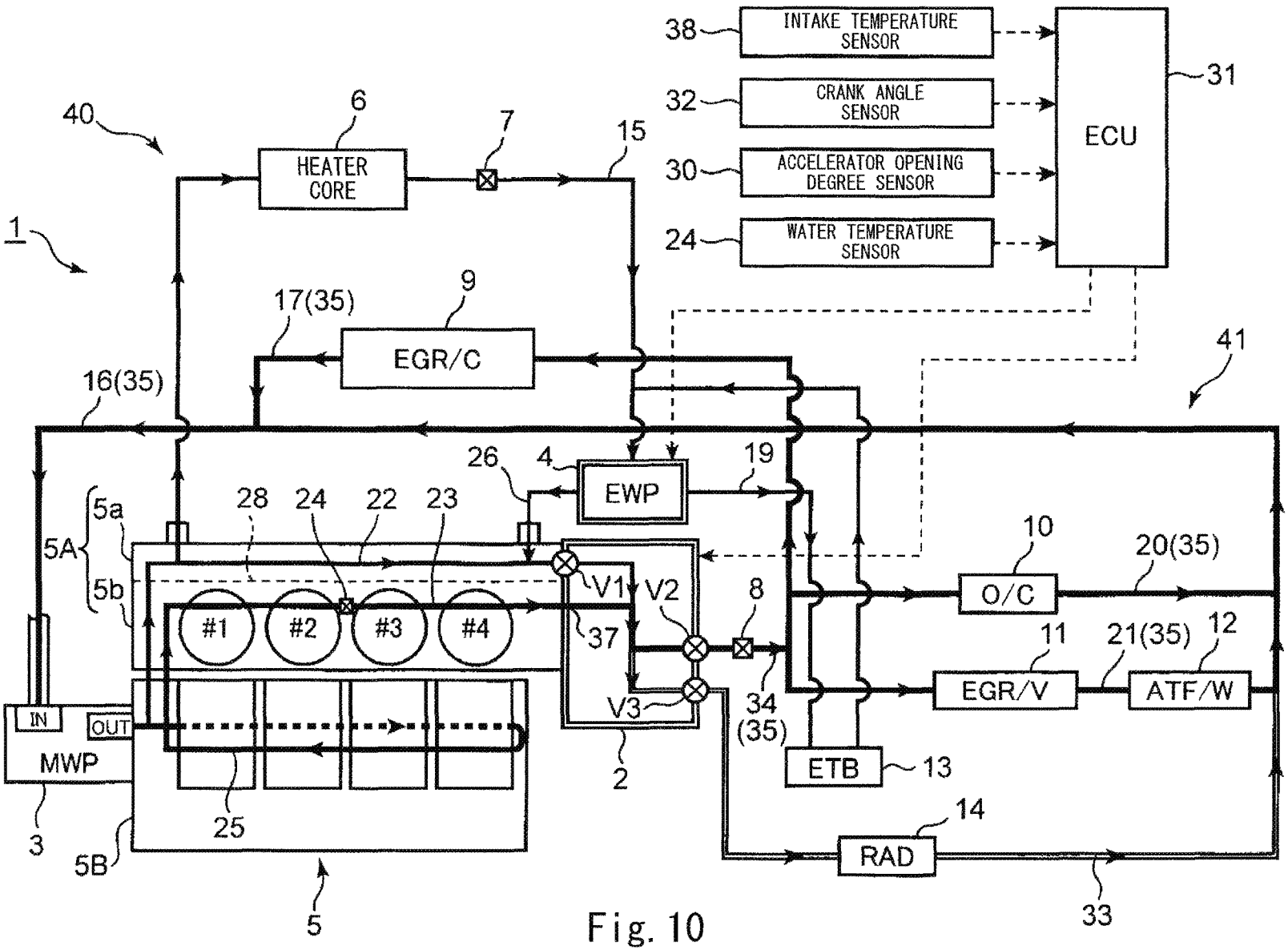
FIG. 10 is a block diagram showing an entire configuration of the engine cooling device according to the embodiment of the present invention and is a diagram showing a control state (control state E) when the combustion chamber wall temperature is the temperature T4 or more, and an engine load is less than a predetermined value.
Figure 12:
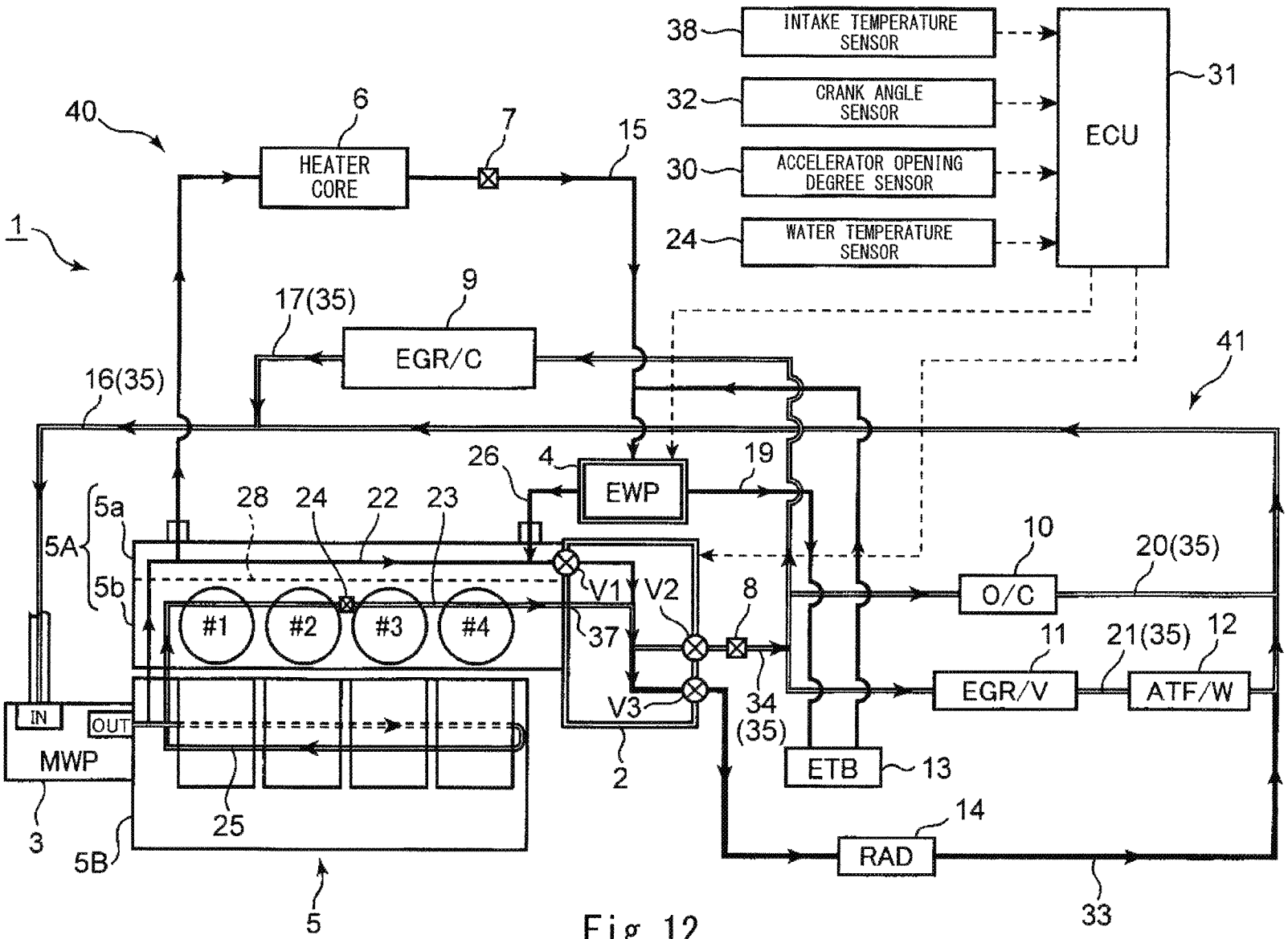
FIG. 12 is a block diagram showing an entire configuration of the engine cooling device according to the embodiment of the present invention and is a diagram showing a control state (control state F) when the combustion chamber wall temperature is the temperature T4 or more, and the engine load is the predetermined value or more.

In a case where all the flow control valves V1, V2, and V3 are open, the cooling water flows among the exhaust-side channel 22, the main channel 23, the auxiliary device channel 35, and the radiator channel 33 through the rotary valve device 2 (see FIGS. 10 and 12). To be specific, a channel connecting the exhaust-side channel 22, the main channel 23, the auxiliary device channel 35, and the radiator channel 33 is formed in the rotary valve device 2.

To be specific, the flow control valves V1, V2, and V3 constitute a channel switching valve.

To supply the cooling water to the heater circulation passage 40, the operation of the heater pump 4 is only required, and the flow control valves V1, V2, and V3 do not have to be open (see FIGS. 3, 4, 6, 8, 10, and 12). To be specific, as long as the heater pump 4 is operating, the cooling water circulates in the heater circulation passage 40 regardless of whether or not the flow control valves V1, V2, and V3 are open.

Configuration of Auxiliary Device Circulation Passage 41

The auxiliary device circulation passage 41 (see FIG. 1) is a passage in which the cooling water circulates. The auxiliary device circulation passage 41 includes the block channel 25, the main channel 23, the upstream channel 34, an oil cooler channel 20, an EGR valve channel 21, an EGR cooler channel 17, a return channel 16, the channels in the rotary valve device 2, and the radiator channel 33.

The oil cooler channel 20, the EGR valve channel 21, the EGR cooler channel 17, and the return channel 16 constitute the auxiliary device channel 35.

The block channel 25 is a channel extending through the cylinder block 5B. An upstream end portion of the block channel 25 is connected to a discharge port of the auxiliary device pump 3.

The main channel 23 is a channel extending through the portions of the cylinder head 5A other than the exhaust port-side portion, that is, a channel extending through the portions around the combustion chambers and the intake port-side portion. An end portion of the main channel 23 which portion is located at an opposite side of the rotary valve device 2 is connected to the block channel 25.

The upstream channel 34 is a channel through which the cooling water flowing out from the opening portion H4 (flow control valve V2) of the rotary valve device 2 is guided to the oil cooler channel 20, the EGR valve channel 21, and the EGR cooler channel 17. An upstream end portion of the upstream channel 34 is connected to the opening portion H2. A downstream end portion of the upstream channel 34 is connected to an upstream end portion of the oil cooler channel 20, an upstream end portion of the EGR valve channel 21, and an upstream end portion of the EGR cooler channel 17. The water temperature sensor 8 configured to detect the temperature of the cooling water is provided at the upstream channel 34.

A downstream end portion of the oil cooler channel 20 is connected to the return channel 16. The oil cooler 10 is provided at the oil cooler channel 20.

A downstream end portion of the EGR valve channel 21 is connected to the return channel 16. The EGR valve 11 and the ATF warmer 12 are provided at the EGR valve channel 21.

An upstream end portion of the radiator channel 33 is connected to the opening portion H3 (flow control valve V3) of the rotary valve device 2. A downstream end portion of the radiator channel 33 is connected to the return channel 16. The radiator 14 is provided at the radiator channel 33.

The return channel 16 is a channel through which the cooling water flowing out from the oil cooler channel 20, the EGR valve channel 21, the radiator channel 33, and the EGR cooler channel 17 returns to the auxiliary device pump 3. Each of the downstream end portions of the oil cooler channel 20, the EGR valve channel 21, the radiator channel 33, and the EGR cooler channel 17 is connected to an upstream portion or midstream portion of the return channel 16. A downstream end portion of the return channel 16 is connected to a suction port of the auxiliary device pump 3.

To circulate the cooling water in the auxiliary device circulation passage 41, at least one of the flow control valve V2 and the flow control valve V3 needs to be open in a state where the auxiliary device pump 3 is operating (see FIGS. 6, 8, 10, and 12).

The water temperature sensor 24 is provided at the main channel 23 and detects the temperature of the cooling water flowing through the main channel 23. The water temperature sensor 7 is provided at the heater channel 15 so as to be located downstream of the heater core 6 and detects the temperature of the cooling water flowing out from the heater core 6. The water temperature sensor 8 is provided at the upstream channel 34 and detects the temperature of the cooling water flowing out from the rotary valve device 2. The accelerator opening degree sensor 30 detects a stepped-on amount of an accelerator pedal by a driver as an accelerator opening degree. The crank angle sensor 32 detects a rotation angle of the crank shaft. The intake temperature sensor 38 detects a temperature of the intake air flowing into the engine 5.

A group of the water temperature sensor 8, the accelerator opening degree sensor 30, the crank angle sensor 32, and the intake temperature sensor 38 corresponds to a "temperature detecting portion" of the present invention. Further, the accelerator opening degree sensor 30 corresponds to an "engine load detecting portion" of the present invention.

Configuration of ECU 31

The ECU 31 is constituted by a CPU, a RAM, a ROM, and the like. Based on signals transmitted from the water temperature sensor 24, the accelerator opening degree sensor 30, and the crank angle sensor 32 and indicating respective detected values, the ECU 31 generates control signals for controlling operations of the rotary valve device 2 and the heater pump 4 and transmits the control signals to the rotary valve device 2 and the heater pump 4. The ECU 31 corresponds to the "temperature detecting portion," the "engine load detecting portion," and a "control portion" of the present invention.

The detected values of the water temperature sensors 7 and 8 are used to determine whether or not the temperatures of the heater core 6 and the engine 5 are appropriately adjusted while the rotary valve device 2 and the heater pump 4 are being controlled by the ECU 31. In the following, an explanation of the operation of controlling the rotary valve device 2 and the heater pump 4 using the detected values of the water temperature sensors 7 and 8 is omitted.

Next, an operation of controlling the rotary valve device 2 and the heater pump 4 by the ECU 31 will be explained in reference to flow charts of FIGS. 14 and 15.

Figure 14:
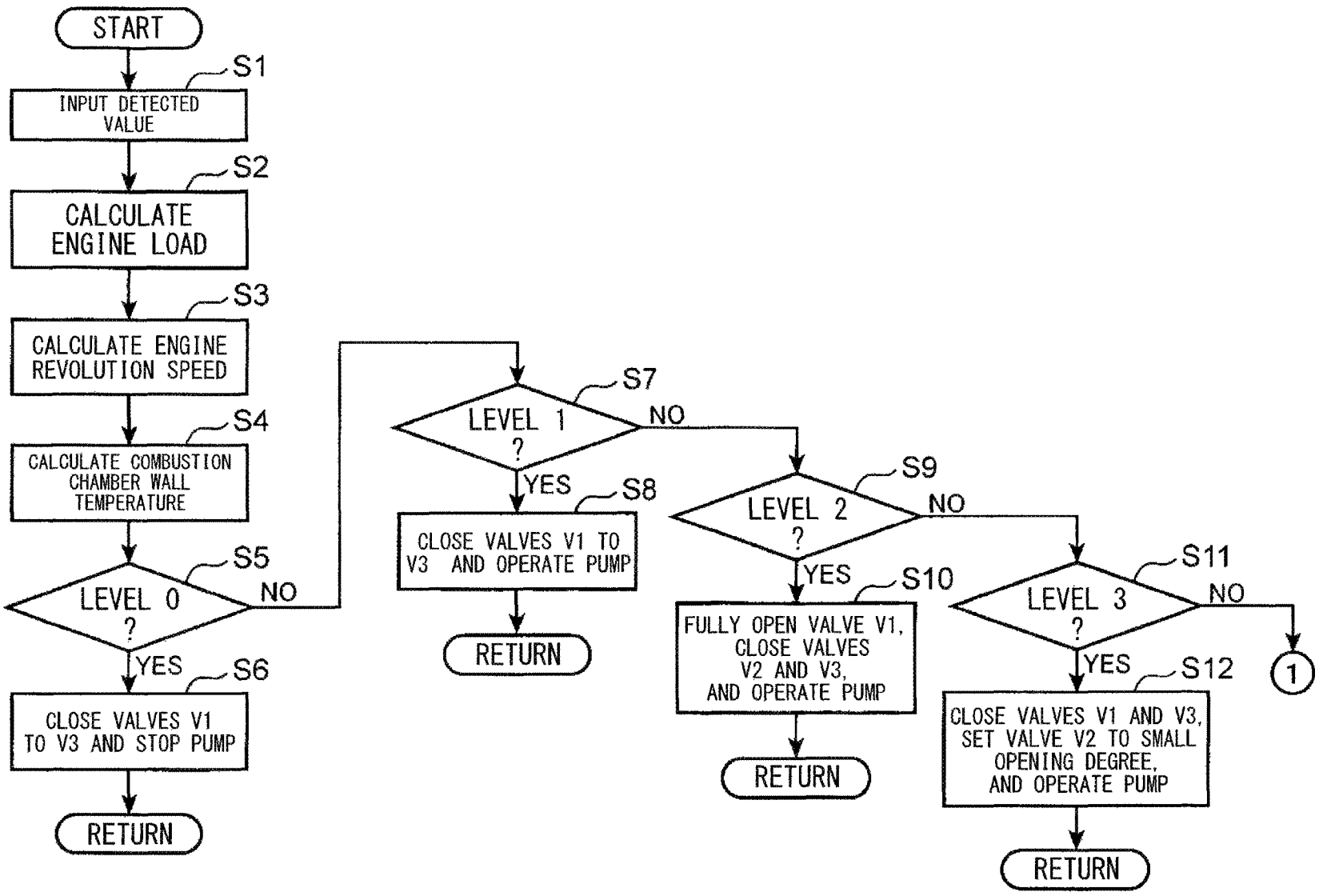
FIG. 14 is a flow chart showing a control operation performed by an ECU in the embodiment of the present invention.

As shown in FIG. 14, first, the ECU 31 receives the signals indicating the detected values from the water temperature sensor 24, the accelerator opening degree sensor 30, the crank angle sensor 32, and the intake temperature sensor 38 (Step S1).

Next, based on the accelerator opening degree detected by the accelerator opening degree sensor 30, the ECU 31 calculates an engine load (driving torque generated by the engine) generated by the engine (Step S2).

Next, based on the crank angle detected by the crank angle sensor 32, the ECU 31 calculates an engine revolution speed (Step S3).

Next, based on the temperature of the cooling water, the engine load, the engine revolution speed, and the temperature of the intake air, the ECU 31 calculates a temperature (hereinafter referred to as a "combustion chamber wall temperature") of a wall surface of the combustion chamber of the engine 5, the wall surface being located close to the cylinder head 5A (Step S4). The combustion chamber wall temperature corresponds to the "temperature of the engine" of the present invention.

Next, the ECU 31 determines whether or not the combustion chamber wall temperature falls within a temperature range LEVEL 0 (Step S5). The temperature range LEVEL 0 is a temperature less than the temperature T0 corresponding to a cold state and is included in a "first temperature range" in the present invention.

If YES in Step S5, the ECU 31 performs such a control operation that: each of the opening degrees of the flow control valves V1 to V3 is set to a fully closed state; and the heater pump 4 is set to a stop state (Step S6).

By performing the control operation in Step S6, as shown in FIG. 2A, the rotary valve device 2 becomes a state where: the opening portion H1 and the cutout hole K1 do not overlap each other; the opening portion H2 and the cutout hole K2 do not overlap each other; and the opening portion H3 and the cutout hole K3 do not overlap each other. With this, as shown in FIG. 1, the cooling water does not flow through any channels of the cooling device 1, so that the warming-up of the engine 5 is promoted. Hereinafter, the control state in Step S6 is referred to as a "water stop state." After the processing in Step S6 is executed, the ECU 31 returns to Step S1.

If NO in Step S5, the ECU 31 determines whether or not the combustion chamber wall temperature falls within a temperature range LEVEL 1 (Step S7). The temperature range LEVEL 1 is a temperature range of the temperature T0 or more and less than the temperature T1 (during the warming-up) and is included in the "first temperature range" of the present invention.

If YES in Step S7, the ECU 31 performs such a control operation that: each of the opening degrees of the flow control valves V1 to V3 is set to the fully closed state; and the heater pump 4 is caused to operate (Step S8). The heater pump 4 operates such that the cooling water flows from the heater channel 15 to the communication channel 26 and the ETB channel 19.

By performing the control operation in Step S8, as shown in FIG. 3, the cooling water flows through the exhaust-side channel 22, the heater channel 15, the communication channel 26, and the ETB channel 19. To be specific, the cooling water circulates in the heater circulation passage 40 constituted by the exhaust-side channel 22, the heater channel 15, the communication channel 26, and the ETB channel 19. Hereinafter, the control state in Step S8 is referred to as a "control state A." After the processing in Step S8 is executed, the ECU 31 returns to Step S1.

If NO in Step S7, the ECU 31 determines whether or not the combustion chamber wall temperature falls within a temperature range LEVEL 2 (Step S9). The temperature range LEVEL 2 is a temperature range of the temperature T1 or more and less than the temperature T2 (during the warming-up) and is included in the "first temperature range" of the present invention.

If YES in Step S9, the ECU 31 performs such a control operation that: the opening degree of the flow control valve V1 is set to a fully open state; each of the opening degrees of the flow control valves V2 and V3 is set to the fully closed state; and the heater pump 4 is caused to operate (Step S10).

Figure 5:
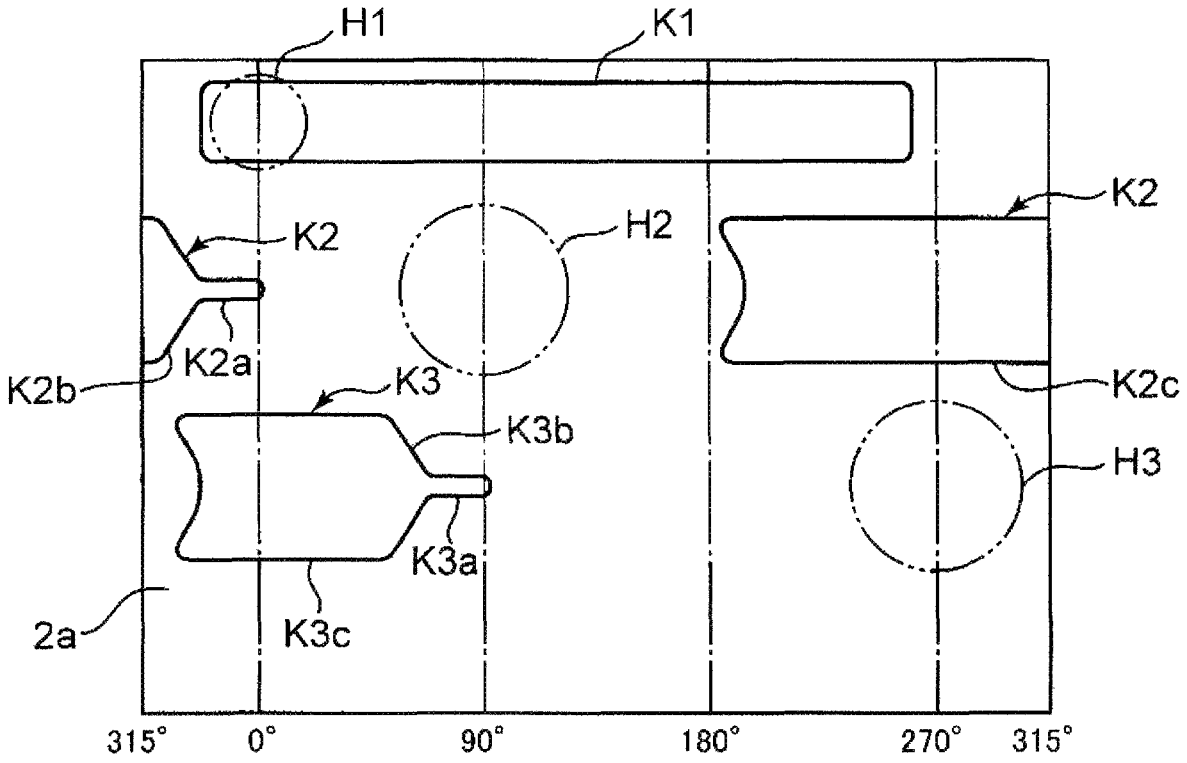
FIG. 5 is a development view showing the peripheral wall of the rotary valve in the control state shown in FIG. 4.

Specifically, by the rotation of the rotary valve 2*a* in the housing 2*b*, as shown in FIG. 5, the rotary valve device 2 becomes a state where: the opening portion H1 and the cutout hole K1 overlap each other; the opening portion H2 and the cutout hole K2 do not overlap each other; and the opening portion H3 and the cutout hole K3 do not overlap each other. With this, as shown in FIG. 4, the main channel 23 and the exhaust-side channel 22 are connected to each other. By the connection of the main channel 23 with the exhaust-side channel 22, the main channel 23 is incorporated in the heater circulation passage 40 to constitute, together with the exhaust-side channel 22 and the heater channel 15, a passage in which the cooling water circulates.

To be specific, the exhaust-side channel 22, the channel in the rotary valve device 2 (i.e., the channel connecting the flow control valve V1 and the communication portion 37), the main channel 23, the portion of the block channel 25 which portion is located at the opposite side of the rotary valve device 2, the heater channel 15, the communication channel 26, and the ETB channel 19 constitute a circulation passage, and the cooling water circulates in the entire circulation passage. Hereinafter, the control state in Step S10 is referred to as a "control state B." After the processing in Step S10 is executed, the ECU 31 returns to Step S1.

If NO in Step S9, the ECU 31 determines whether or not the combustion chamber wall temperature falls within a temperature range LEVEL 3 (Step S11). The temperature range LEVEL 3 is a temperature range of the temperature T2 or more and less than the temperature T3 (during the warming-up) and corresponds to a "second temperature range" of the present invention.

If YES in Step S11, the ECU 31 performs such a control operation that: each of the flow control valves V1 and V3 is set to the fully closed state; the opening degree of the flow control valve V2 is set to a small opening degree; and the heater pump 4 is caused to operate (Step S12).

Figure 7:
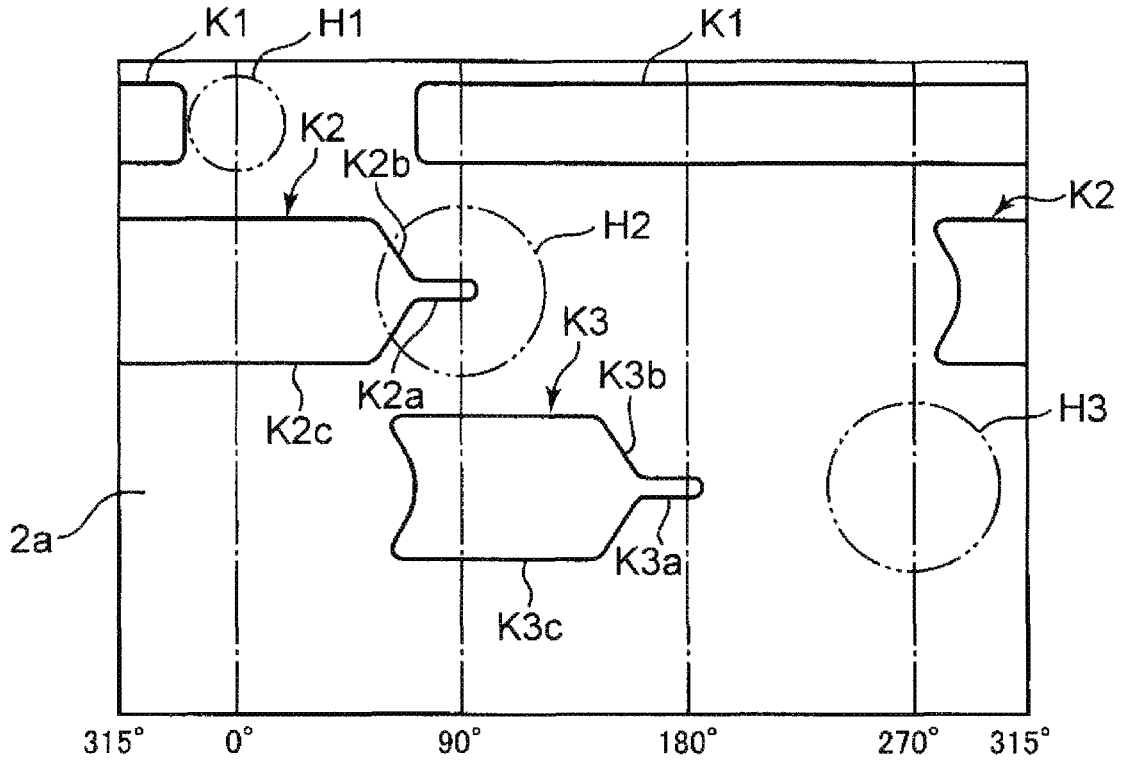
FIG. 7 is a development view showing the peripheral wall of the rotary valve in the control state shown in FIG. 6.

Specifically, as shown in FIG. 7, the ECU 31 rotates the rotary valve 2*a* such that the cutout holes K1, K2, and K3 move from a left side to a right side in FIG. 7 (hereinafter referred to as "right rotation"). By the rotation of the rotary valve 2*a*, as shown in FIG. 7, the rotary valve device 2 becomes a state where: the opening portion H1 and the cutout hole K1 do not overlap each other (the flow control valve V1 is set to the fully closed state); the opening portion H2 and the projecting portion K2*a* and tapered portion K2*b* of the cutout hole K2 overlap one another (the flow control valve V2 is set to a small opening degree state); and the opening portion H3 and the cutout hole K3 do not overlap each other (the flow control valve V3 is set to the fully closed state).

By opening the flow control valve V2, as shown in FIG. 6, the main channel 23 and the auxiliary device channel 35 are connected to each other. Then, by pumping power of the auxiliary device pump 3, the cooling water circulates through the main channel 23, the channel in the rotary valve device 2 (i.e., the channel connecting the communication portion 37 and the flow control valve V2), the auxiliary device channel 35, and the block channel 25. To be specific, the cooling water circulates in the auxiliary device circulation passage 41.

By closing the flow control valve V1, the channel between the exhaust-side channel 22 and the main channel 23 in the rotary valve device 2 is blocked. Therefore, the cooling water does not flow between the heater circulation passage 40 and the auxiliary device circulation passage 41. To be specific, the heater circulation passage 40 and the heater circulation passage 40 serve as circulation passages independent from each other. Thus, the cooling water in the heater circulation passage 40 and the cooling water in the auxiliary device circulation passage 41 are not mixed with each other. The cooling water circulates individually in these circulation passages.

Since the flow control valve V2 becomes the small opening degree state, a large amount of low-temperature cooling water in the auxiliary device channel 35, that is, in the oil cooler channel 20, the EGR valve channel 21, the EGR cooler channel 17, and the return channel 16 is prevented from flowing into the main channel 23 in a short period of time when the flow control valve V2 is open.

Further, in Step S12, the cutout hole K2 starts overlapping the opening portion H2 from the projecting portion K2*a* (see FIG. 7). Therefore, in a predetermined initial period after the main channel 23 and the auxiliary device channel 35 are connected to each other, the flow rate is restricted to a low flow rate. After that, the flow rate gradually increases until the opening portion H2 and the projecting portion K2*a* and tapered portion K2*b* of the cutout hole K2 overlap one another. Therefore, when connecting the main channel 23 and the auxiliary device channel 35, the low-temperature cooling water in the auxiliary device channel 35 gradually flows into the main channel 23, so that a steep temperature decrease around the combustion chambers can be suppressed. Hereinafter, the control state in Step S12 is referred to as a "control state C."

Figure 15:
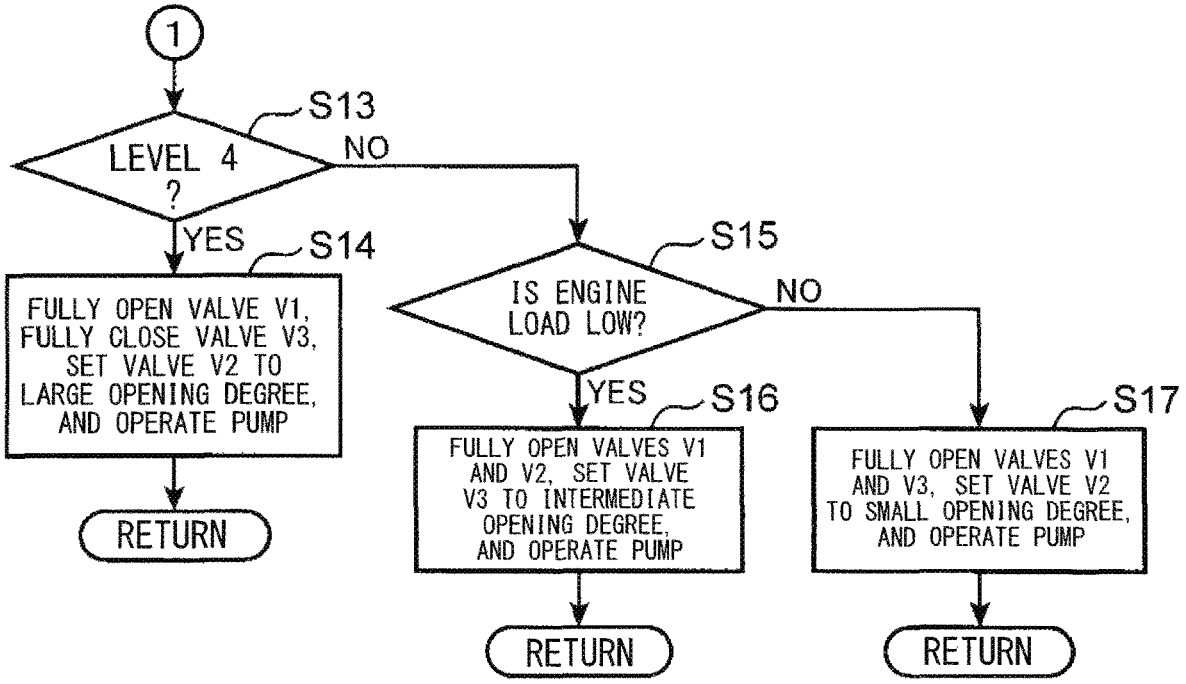
FIG. 15 is a flow chart showing the control operation performed by the ECU in the embodiment of the present invention.

If NO in Step S11, as shown in FIG. 15, the ECU 31 determines whether or not the combustion chamber wall temperature falls within a temperature range LEVEL 4 (Step S13). The temperature range LEVEL 4 is a temperature range of the temperature T3 or more and less than the temperature T4 (during the warming-up) and corresponds to a "third temperature range" of the present invention. The temperature T4 is a temperature used as a criterion for determining whether or not the warming-up of the engine is being performed. To be specific, when the combustion chamber wall temperature is less than the temperature T4, the warming-up of the engine is being performed. When the combustion chamber wall temperature is the temperature T4 or more, the warming-up of the engine is being completed.

If YES in Step S13, the ECU 31 performs such a control operation that the rotary valve device 2 becomes a state where: the opening degree of the flow control valve V1 is set to the fully open state; the opening degree of the flow control valve V3 is set to the fully closed state; the opening degree of the flow control valve V2 is set to a large opening degree (that is slightly smaller than the fully open state); and the heater pump 4 is caused to operate (Step S14).

Figure 9:
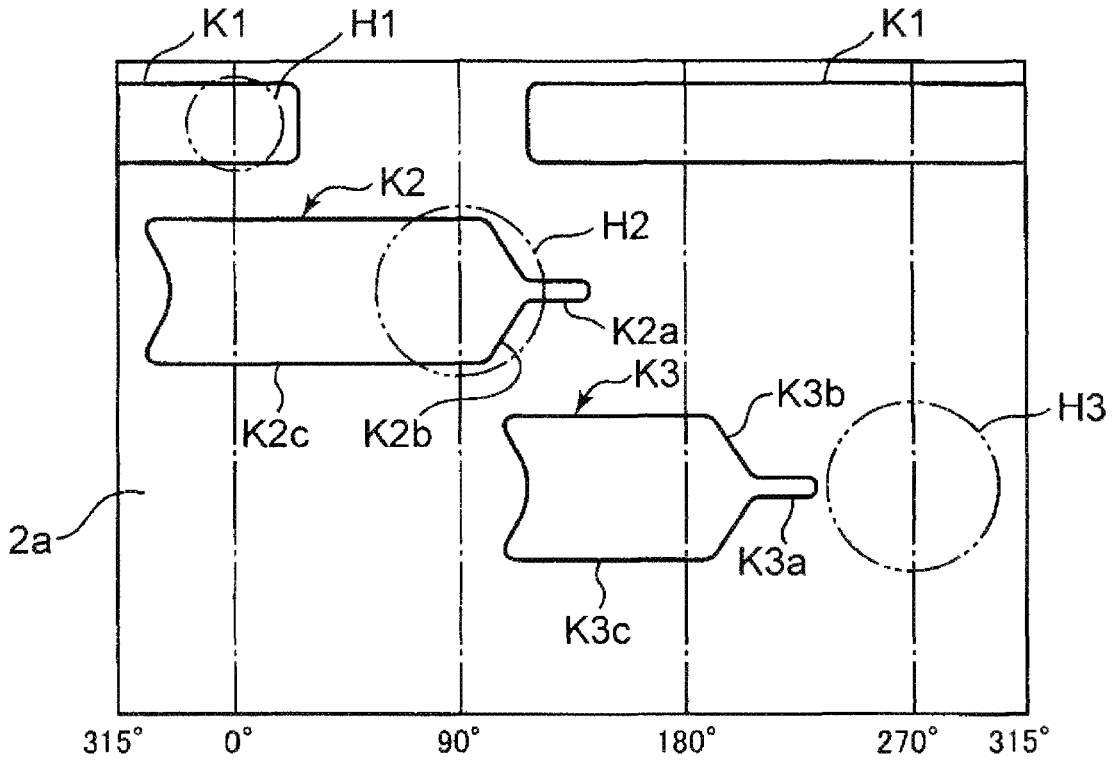
FIG. 9 is a development view showing the peripheral wall of the rotary valve in the control state shown in FIG. 8.

Specifically, the ECU 31 causes the rotary valve 2*a* to perform the right rotation (see FIG. 9). By the right rotation of the rotary valve 2*a*, as shown in FIG. 9, the rotary valve device 2 becomes a state where: the opening portion H1 and the cutout hole K1 overlap each other (the flow control valve V1 is set to the fully open state); the opening portion H2 and the tapered portion K2*b* and main portion K2*c* of the cutout hole K2 overlap one another (the flow control valve V2 is set to the large opening degree state); and the opening portion H3 and the cutout hole K3 do not overlap each other (the flow control valve V3 is set to the fully closed state).

As the opening degree of the flow control valve V2 increases, the amount of cooling water flowing out from the rotary valve device 2 to the auxiliary device channel 35 increases.

By opening the flow control valves V1 and V2, as shown in FIG. 8, the exhaust-side channel 22, the main channel 23, and the auxiliary device channel 35 are connected to one another. Therefore, the cooling water flows through the heater circulation passage 40 and the auxiliary device circulation passage 41 (except for the radiator channel 33).

Specifically, the flow direction of the cooling water in the exhaust-side channel 22 becomes opposite to that in the control state C, and the exhaust-side channel 22, the main channel 23, the channels in the rotary valve device 2 (i.e., the channels connecting the flow control valve V1, the communication portion 37, and the flow control valve V2), the auxiliary device channel 35, and the block channel 25 constitute the auxiliary device circulation passage 41.

Further, the channel in the rotary valve device 2 (i.e., the channel connecting the flow control valve V1 and the flow control valve V2), the auxiliary device channel 35, the portion of the block channel 25 which portion is located at the opposite side of the rotary valve device 2, the portion of the exhaust-side channel 22 which portion is located at the opposite side of the rotary valve device 2, the heater channel 15, and the ETB channel 19 constitute the heater circulation passage 40. To be specific, the heater circulation passage 40 and the auxiliary device circulation passage 41 are connected to each other, and the cooling water circulates in the entire heater circulation passage 40 and the entire auxiliary device circulation passage 41. Hereinafter, the control state in Step S14 is referred to as a "control state D."

If NO in Step S13, the ECU 31 determines whether or not the engine load is less than a predetermined threshold (Step S15). The threshold is a value used as a criterion for determining whether or not the engine 5 is in a high load state. To be specific, when the engine load is less than the threshold, the engine 5 is in a low load state or an intermediate load state. When the engine load is the threshold or more, the engine 5 is in a high load state. It should be noted that if NO in Step S13, the combustion chamber wall temperature is the temperature T4 or more.

If YES in Step S15, the ECU 31 performs such a control operation that: each of the flow control valves V1 and V2 is set to the fully open state; the flow control valve V3 is set to an intermediate opening degree state; and the heater pump 4 is caused to operate (Step S16).

Figure 11:
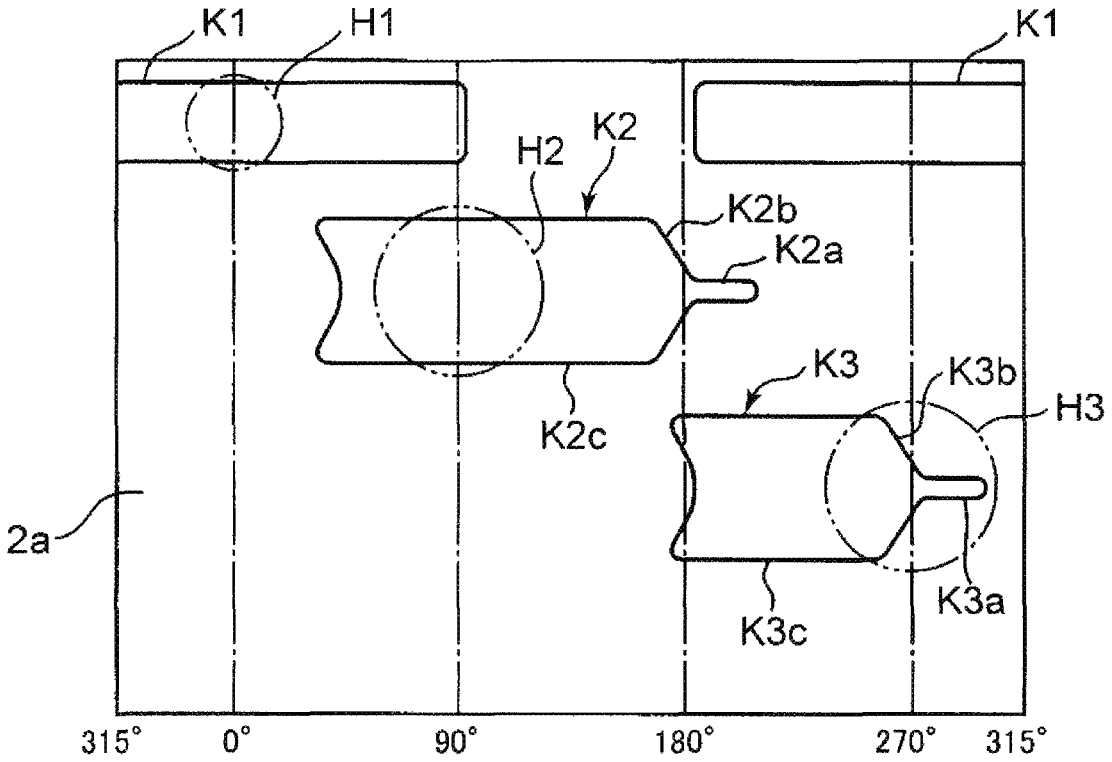
FIG. 11 is a development view showing the peripheral wall of the rotary valve in the operating state shown in FIG. 10.

Specifically, the ECU 31 causes the rotary valve 2*a* to perform the right rotation (see FIG. 11). By the right rotation of the rotary valve 2*a*, as shown in FIG. 11, the rotary valve device 2 becomes a state where: the opening portion H1 and the cutout hole K1 overlap each other (the flow control valve V1 is set to the fully open state); the opening portion H2 and the main portion K2*c* of the cutout hole K2 overlap each other (the flow control valve V2 is set to the fully open state); and the opening portion H3 and the projecting portion K3*a*, tapered portion K3*b*, and main portion K3*c* of the cutout hole K3 overlap one another (the flow control valve V3 is set to the intermediate opening degree state).

As the opening degree of the flow control valve V2 increases, the amount of cooling water flowing out from the rotary valve device 2 to the auxiliary device channel 35 increases.

By opening the flow control valves V1, V2, and V3, the exhaust-side channel 22, the main channel 23, the auxiliary device channel 35, and the radiator channel 33 are connected to one another. Therefore, as shown in FIG. 10, the cooling water flows in the heater circulation passage 40 and the auxiliary device circulation passage 41 (including the radiator channel 33). To be specific, the cooling water circulates in the entire heater circulation passage 40 and the entire auxiliary device circulation passage 41.

Since the flow control valve V3 becomes the intermediate opening degree state, a large amount of low-temperature cooling water in the radiator channel 33 is prevented from flowing into the main channel 23 in a short period of time.

Further, in Step S16, the cutout hole K3 starts overlapping the opening portion H3 from the projecting portion K3*a*. Therefore, in a predetermined initial period after the main channel 23 and the radiator channel 33 are connected to each other, the flow rate is restricted to a low flow rate. After that, the flow rate gradually increases until the opening portion H3 and the projecting portion K3*a* and tapered portion K3*b* of the cutout hole K3 overlap one another. Therefore, when connecting the main channel 23 and the radiator channel 33, the low-temperature cooling water in the radiator channel 33 gradually flows into the main channel 23, so that a steep temperature decrease around the combustion chambers can be suppressed. Hereinafter, the control state in Step S16 is referred to as a "control state E."

If NO in Step S15, the ECU 31 performs such a control operation that: each of the opening degrees of the flow control valves V1 and V3 is set to the fully open state; the opening degree of the flow control valve V2 is set to the small opening degree; and the heater pump 4 is caused to operate (Step S17).

Figure 13:
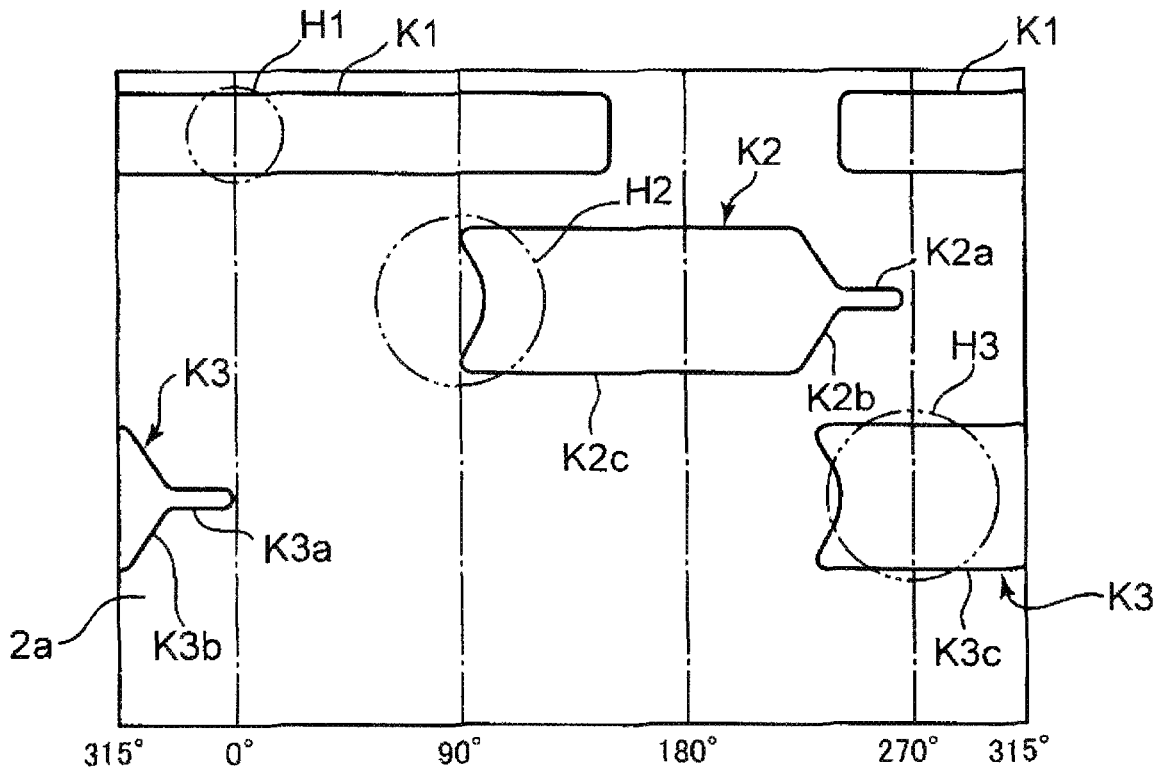
FIG. 13 is a development view showing the peripheral wall of the rotary valve in the operating state shown in FIG. 12.

Specifically, the ECU 31 causes the rotary valve 2*a* to perform the right rotation (see FIG. 13). By the right rotation of the rotary valve 2*a*, as shown in FIG. 13, the rotary valve device 2 becomes a state where: the opening portion H1 and the cutout hole K1 overlap each other (the flow control valve V1 is set to the fully open state); the opening portion H2 and one end portion (that is concave) of the main portion K2*c* of the cutout hole K2 overlap each other (the flow control valve V2 is set to a small open state); and the opening portion H3 and the main portion K3*c* of the cutout hole K3 overlap each other (the flow control valve V3 is set to the fully open state).

As the opening degree of the flow control valve V2 decreases, the amount of cooling water flowing out from the rotary valve device 2 to the auxiliary device channel 35 decreases.

As the opening degree of the flow control valve V3 increases, the amount of cooling water flowing out from the rotary valve device 2 to the radiator channel 33 increases. To be specific, the amount of cooling water flowing through the radiator 14 increases, so that a cooling capability of the radiator 14 increases. Hereinafter, the control state in Step S17 is referred to as a "control state F."

Figure 16:
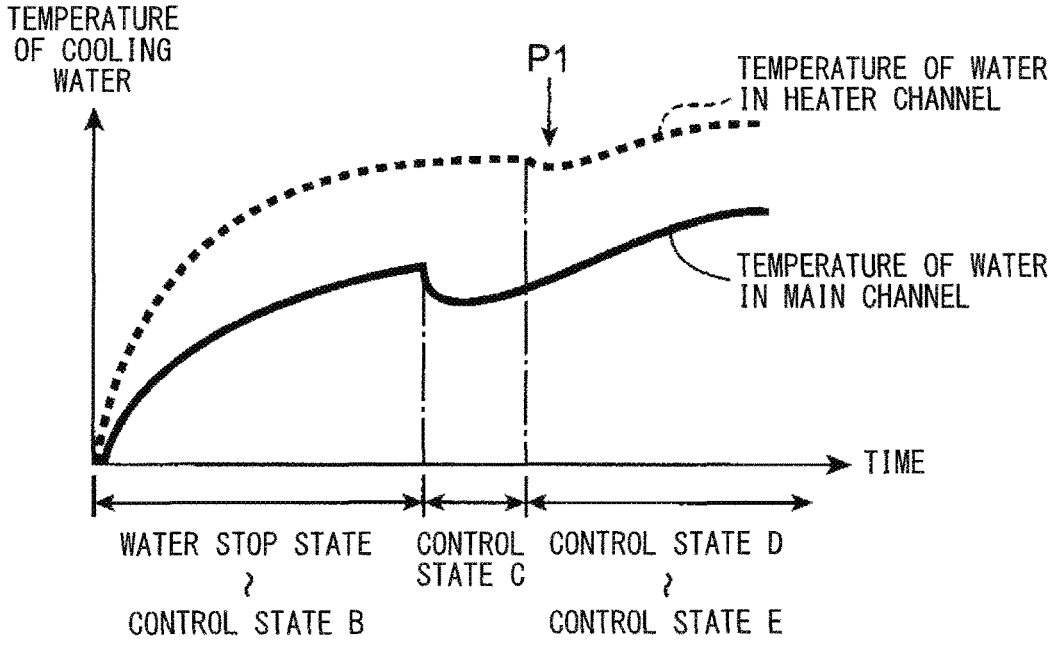
FIG. 16 is a diagram showing an effect obtained by setting the control state (control state C) shown in FIG. 6 and is a diagram showing a temperature change of the cooling water in a heater channel and a temperature change of the cooling water in a main channel.

FIG. 16 is a diagram showing an effect obtained by setting the control state C shown in FIGS. 6 and 7. In FIG. 16, a broken line shows a temperature change of the cooling water in the heater channel, and a solid line shows a temperature change of the cooling water in the main channel.

As shown in FIG. 16, as the combustion chamber wall temperature increases, the control state changes in the order of the water stop state, the control state A, the control state B, the control state C, the control state D, and the control state E (F).

In the present embodiment, the control state C (state where the cooling water is supplied individually to the heater circulation passage 40 and the auxiliary device circulation passage 41 which are not connected to each other) is set between the control state B and control state D. Therefore, the decrease in the cooling performance with respect to the auxiliary devices 9 and 10 can be suppressed while promoting the warming-up of the heater core 6.

To be specific, since the high-temperature exhaust gas flows through the exhaust port, the cooling water flowing through the exhaust-side channel 22 is warmed up more quickly than the cooling water flowing through the main channel 23 and is made higher in temperature than the cooling water flowing through the main channel 23. At each of stages of the water stop state and the control states A, B, C, and D, the cooling water having flowed through the exhaust-side channel 22 is supplied to the heater channel 15 during the engine warming-up. With this, the warming-up of the heater core 6 is promoted.

At the stage of the control state B, the auxiliary devices 9 and 10 are still in a low temperature state. Therefore, the necessity of cooling the auxiliary devices 9 and 10 at this stage is low. On this account, the warming-up of the heater core 6 is promoted by performing the control operation of circulating the cooling water only in the heater circulation passage 40.

At the stage of the control state C, the auxiliary devices 9 and 10 are increased in temperature. Therefore, by circulating the cooling water in the auxiliary device circulation passage 41, the auxiliary devices 9 and 10 are cooled. At this time, the low-temperature cooling water in the auxiliary device channel 35 flows into the main channel 23 to absorb heat of the portion 5*b* of the cylinder head 5A other than the exhaust-side portion, so that the cooling water increases in temperature. Further, by performing the control operation of circulating the cooling water in the heater circulation passage 40 that is not connected to the auxiliary device circulation passage 41, that is, is provided independently from the auxiliary device circulation passage 41, the warming-up of the heater core 6 can be performed while preventing the low-temperature cooling water in the auxiliary device channel 35 from flowing into the heater channel 15.

At the stage of the control state D, the auxiliary device circulation passage 41 and the heater circulation passage 40 are connected to each other, and the cooling water is caused to circulate in the entire circulation passages 40 and 41. At a stage of shifting to the control state D, the cooling water in the auxiliary device channel 35 is already increased in temperature. Therefore, the decrease in the temperature of the heater core 6 when the cooling water flows from the auxiliary device channel 35 into the heater channel 15 is suppressed (see a portion shown by an arrow P1 in FIG. 16). On this account, without restricting the flow rate of the cooling water in the auxiliary device circulation passage 41, the decrease in the temperature of the heater core 6 can be suppressed, and the decrease in the cooling performance with respect to the auxiliary devices 9 and 10 can be suppressed.

Figure 17:
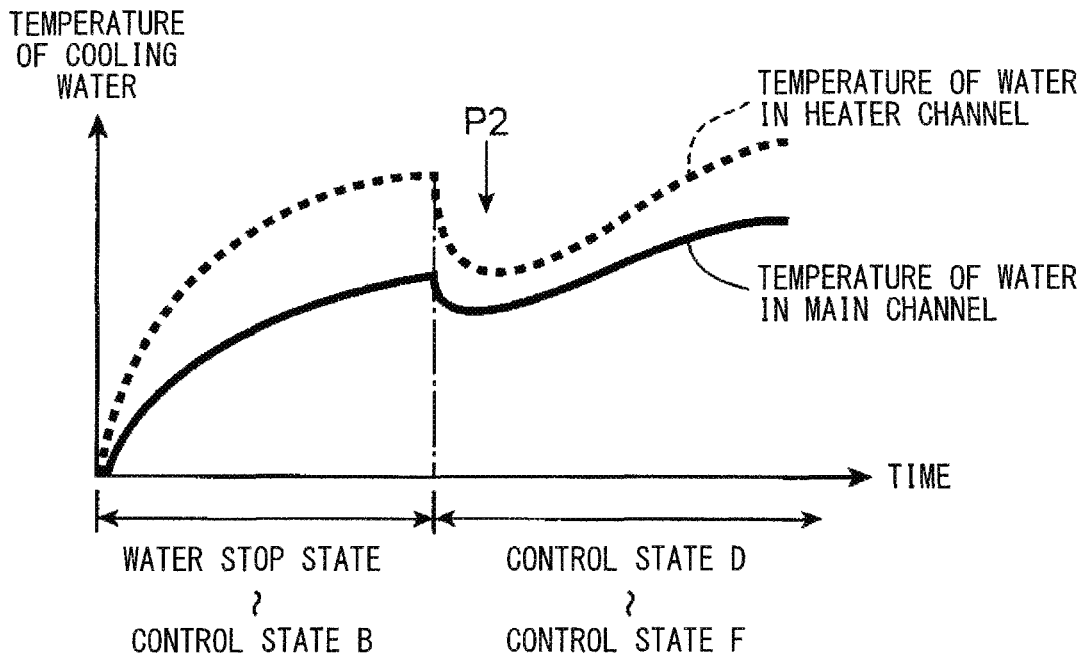
FIG. 17 is a diagram showing the temperature change of the cooling water in the heater channel and the temperature change of the cooling water in the main channel in a case where the control state shown in FIG. 6 is not set.

If the control state shifts from the control state B directly to the control state D without setting the control state C, as shown in FIG. 17, there is a possibility that a large amount of low-temperature cooling water in the auxiliary device channel 35 flows to the cooling water in the heater channel 15 at the time of shifting to the control state D, and this causes the steep temperature decrease of the heater core 6 (see a portion shown by an arrow P2 in FIG. 17). However, according to the present invention in which the control state C is set, the steep temperature decrease of the heater core 6 can be avoided (see the portion shown by the arrow P1 in FIG. 16.

As explained above, according to the present embodiment, since the control state C is set between the control state B and the control state D, the decrease in the cooling performance with respect to the auxiliary devices 9 and 10 can be suppressed while promoting the warming-up of the heater core 6.

Further, each of the flow control valves V2 and V3 restricts the flow rate to a low flow rate in a predetermined initial period after the main channel 23 and the auxiliary device channel 35 are connected to each other, and then gradually increases the flow rate to a predetermined flow rate. Therefore, the low-temperature cooling water in the auxiliary device channel 35 gradually flows into the main channel 23. On this account, the steep temperature decrease around the combustion chambers can be suppressed.

When the combustion chamber wall temperature becomes the temperature T4 or more (when the warming-up is completed), the radiator channel 33 is connected to the auxiliary device channel 35. Therefore, the cooling water can be cooled by the radiator 14 after the warming-up is completed.

Further, when the combustion chamber wall temperature becomes the temperature T4 or more, the ECU 31 performs a control operation of decreasing the flow rate of the cooling water flowing through the auxiliary device channel 35 and increasing the flow rate of the cooling water flowing through the radiator channel 33 as the accelerator opening degree increases. Therefore, when the engine load is high, such as when a vehicle climbs a hill, a cooling function for the engine 5 and the auxiliary devices 9 and 10 can be enhanced, so that the engine 5 and the auxiliary devices 9 and 10 can operate appropriately.

Further, the rotary valve device 2 includes the flow control valves V1, V2, and V3 corresponding to the exhaust-side channel 22, the auxiliary device channel 35, and the radiator channel 33, respectively. Therefore, by opening or closing the flow control valve V1 corresponding to the exhaust-side channel 22, the flow control valve V2 corresponding to the auxiliary device channel 35, and the flow control valve V3 corresponding to the radiator channel 33, the stage of the cooling device 1 of the engine 5 can be shifted among the stages of the water stop state and the control states A, B, C, D, E, and F. Further, since the rotary valve device 2 does not include a valve corresponding to the main channel 23, the configuration of the rotary valve device 2 can be simplified.

Further, the heater channel 15 extends through the ETB 13 configured to adjust the amount of intake air supplied to the cylinder head 5A. Therefore, the warming-up of the ETB 13 can be quickly performed. With this, even in a case where the ETB 13 is frozen at the time of the cold start of the engine 5, the ETB 13 can be quickly defrosted.

By setting the control state B, heat is applied to the cooling water in the main channel 23 and the exhaust-side channel 22. Therefore, the warming-up of the heater core 6 can be further quickly performed.

Since the heater pump 4 is the electric pump, a necessary amount of cooling water can be caused to circulate when necessary without depending on the engine revolution speed. Thus, the flow rate of the cooling water can be appropriately adjusted. Further, since the electric pump can be driven without through a timing chain that transmits the driving force of the engine 5, the number of parts can be reduced.

In the above embodiment, when the combustion chamber wall temperature becomes the temperature T4 or more, the ECU 31 may further perform a control operation of increasing an ejection amount of the heater pump 4 as the accelerator opening degree increases. By this control operation, the flow rate of the cooling water flowing through the radiator 14 increases as the engine load increases. Therefore, when the engine load is high, such as when a vehicle climbs a hill, the cooling function for the engine 5 and the auxiliary devices 9 and 10 can be further enhanced.

In the above embodiment, the heater pump 4 supplies the cooling water from the heater channel 15 to the communication channel 26 and the ETB channel 19. However, the present embodiment is not limited to this. The heater pump 4 may supply the cooling water from the communication channel 26 and the ETB channel 19 to the heater channel 15. In this case, the flow direction of the cooling water in the heater circulation passage 40 is reversed.

In the above embodiment, one rotary valve device 2 has both the function of the channel switching valve and the function of the flow control valve. However, the present embodiment is not limited to this. For example, a valve device having the function of the channel switching valve and a valve device having the function of the flow control valve may be separately provided.

LIST OF REFERENCE CHARACTERS

1 engine cooling device
2 rotary valve device (channel switching valve, flow control valve)
3 auxiliary device pump
4 heater pump
5 engine
5A cylinder head
5B cylinder block
5*a* exhaust port-side portion of cylinder head
5*b* portion of cylinder head other than exhaust port-side portion
6 heater core
9 EGR cooler
10 oil cooler
11 EGR valve

12 ATF warmer
14 radiator
15 heater channel
16 return channel
17 EGR cooler channel
19 ETB channel
20 oil cooler channel
21 EGR valve channel
22 exhaust-side channel
23 main channel
24 water temperature sensor (temperature detecting portion)
25 block channel
26 communication channel
28 dividing wall
30 accelerator opening degree sensor (engine load detecting portion, temperature detecting portion)
31 ECU (control portion, temperature detecting portion, engine load detecting portion)
32 crank angle sensor (temperature detecting portion)
33 radiator channel
34 upstream channel
35 auxiliary device channel
37 communication portion
38 intake temperature sensor (temperature detecting portion)
40 heater circulation passage
41 auxiliary device circulation passage
H1, H2, H3 opening portion
K1, K2, K3 cutout hole
V1, V2, V3 flow control valve

The invention claimed is:

1. An engine cooling device comprising:

a heater circulation passage in which cooling water circulates, the heater circulation passage including an exhaust-side channel and a heater channel, the exhaust-side channel extending through an exhaust port-side portion of a cylinder head, the heater channel being connected to the exhaust-side channel and extending through a heater core of an air conditioner;

an auxiliary device circulation passage in which the cooling water circulates, the auxiliary device circulation passage including a main channel, a block channel, and an auxiliary device channel, the main channel extending through an intake port-side portion of the cylinder head and a portion of the cylinder head that is located around a combustion chamber, the block channel being connected to an end portion of the main channel and extending through a cylinder block, and the auxiliary device channel being connected to an opposite end of the main channel and extending through an auxiliary device;

a heater pump provided at the heater circulation passage and configured to circulate the cooling water in the heater circulation passage;

an auxiliary device pump provided at the auxiliary device circulation passage and configured to circulate the cooling water in the auxiliary device circulation passage;

a channel switching valve configured to perform connection and disconnection between the main channel and the auxiliary device channel and connection and disconnection between the heater circulation passage and the auxiliary device circulation passage; and a control portion configured to control an operation of the channel switching valve based on a temperature of the engine, wherein:

during warming-up of the engine, the control portion performs such control operations that (i) when the temperature of the engine falls within a first temperature range, the main channel and the auxiliary device channel are not connected to each other, (ii) when the temperature of the engine falls within a second temperature range higher than the first temperature range, the main channel and the auxiliary device channel are connected to each other, and the heater circulation passage and the auxiliary device circulation passage are not connected to each other, and (iii) when the temperature of the engine falls within a third temperature range higher than the second temperature range, the main channel and the auxiliary device channel are connected to each other, and the heater circulation passage and the auxiliary device circulation passage are connected to each other.

2. The engine cooling device according to claim 1, further comprising a flow control valve configured to adjust a flow rate of the cooling water flowing through the auxiliary device channel, wherein the flow control valve restricts the flow rate of the cooling water to a low flow rate in a predetermined initial period after the main channel and the auxiliary device channel are connected to each other by the channel switching valve, and then gradually increases the flow rate of the cooling water to a predetermined flow rate.

3. The engine cooling device according to claim 1, wherein:

the auxiliary device circulation passage further includes a radiator channel connected to the auxiliary device channel and extending through a radiator;

the channel switching valve further performs connection and disconnection between the radiator channel and the auxiliary device channel; and the control portion connects the radiator channel with the auxiliary device channel when the temperature of the engine falls within a fourth temperature range higher than the third temperature range.

4. The engine cooling device according to claim 3, further comprising a flow control valve configured to adjust a flow rate of the cooling water flowing through the auxiliary device channel and a flow rate of the cooling water flowing through the radiator channel, wherein:

the control portion further controls an operation of the flow control valve based on the temperature of the engine and an engine load; and when the temperature of the engine falls within the fourth temperature range, the control portion performs a control operation of decreasing the flow rate of the cooling water flowing through the auxiliary device channel and increasing the flow rate of the cooling water flowing through the radiator channel as the engine load increases.

5. The engine cooling device according to claim 4, wherein:

the control portion further controls an operation of the heater pump based on the temperature of the engine and the engine load; and when the temperature of the engine falls within the fourth temperature range, the control portion performs a control operation of increasing an ejection amount of the heater pump as the engine load increases.

6. The engine cooling device according to claim 3, wherein the channel switching valve includes only a valve corresponding to the exhaust-side channel, a valve corresponding to the auxiliary device channel, and a valve corresponding to the radiator channel.

7. The engine cooling device according to claim 1, wherein the heater channel further extends through a throttle body configured to adjust an amount of intake air supplied to the cylinder head.

8. The engine cooling device according to claim 1, wherein:

the channel switching valve further performs connection and disconnection between the main channel and the heater channel; and when the temperature of the engine falls within a high temperature-side temperature range of the first temperature range, the control portion performs such a control operation that the main channel and the auxiliary device channel are not connected to each other, and the main channel and the heater channel are connected to each other.

9. The engine cooling device according to claim 1, wherein the heater pump is an electric pump.

10. The engine cooling device according to claim 2, wherein:

the auxiliary device circulation passage further includes a radiator channel connected to the auxiliary device channel and extending through a radiator;

the channel switching valve further performs connection and disconnection between the radiator channel and the auxiliary device channel; and the control portion connects the radiator channel with the auxiliary device channel when the temperature of the engine falls within a fourth temperature range higher than the third temperature range.

11. The engine cooling device according to claim 4, wherein the channel switching valve includes only a valve corresponding to the exhaust-side channel, a valve corresponding to the auxiliary device channel, and a valve corresponding to the radiator channel.

12. The engine cooling device according to claim 5, wherein the channel switching valve includes only a valve corresponding to the exhaust-side channel, a valve corresponding to the auxiliary device channel, and a valve corresponding to the radiator channel.

13. An engine cooling device comprising:

a heater circulation passage in which cooling water circulates, the heater circulation passage including an exhaust-side channel and a heater channel, the exhaust-side channel extending through an exhaust port-side portion of a cylinder head, the heater channel being connected to the exhaust-side channel and extending through a heater core of an air conditioner and a throttle body configured to adjust an amount of intake air supplied to the cylinder head;

an auxiliary device circulation passage in which the cooling water circulates, the auxiliary device circulation passage including a main channel, an auxiliary device channel, a block channel, and a radiator channel, the main channel extending through an intake port-side portion of the cylinder head and a portion of the cylinder head that is located around a combustion chamber, the block channel being connected to an end portion of the main channel and extending through a cylinder block, the auxiliary device channel being connected to an opposite end of the main channel and extending through an auxiliary device, and the radiator channel being connected to the auxiliary device channel and extending through a radiator;

a heater pump provided at the heater circulation passage and configured to circulate the cooling water in the heater circulation passage;

an auxiliary device pump provided at the auxiliary device circulation passage and configured to circulate the cooling water in the auxiliary device circulation passage;

a channel switching valve configured to perform connection and disconnection between the main channel and the auxiliary device channel, connection and disconnection between the heater circulation passage and the auxiliary device circulation passage, and connection and disconnection between the radiator channel and the auxiliary device channel, the channel switching valve including only a valve corresponding to the exhaust-side channel, a valve corresponding to the auxiliary device channel, and a valve corresponding to the radiator channel;

a flow control valve configured to adjust a flow rate of the cooling water flowing through the auxiliary device channel and a flow rate of the cooling water flowing through the radiator channel; and a control portion configured to control an operation of the channel switching valve based on a temperature of the engine and also control an operation of the flow control valve and an operation of the heater pump based on the temperature of the engine and an engine load, wherein:

during warming-up of the engine, the control portion performs such control operations that (i) when the temperature of the engine falls within a first temperature range, the main channel and the auxiliary device channel are not connected to each other, (ii) when the temperature of the engine falls within a second temperature range higher than the first temperature range, the main channel and the auxiliary device channel are connected to each other, and the heater circulation passage and the auxiliary device circulation passage are not connected to each other, and (iii) when the temperature of the engine falls within a third temperature range higher than the second temperature range, the main channel and the auxiliary device channel are connected to each other, and the heater circulation passage and the auxiliary device circulation passage are connected to each other;

the control portion connects the radiator channel with the auxiliary device channel when the temperature of the engine falls within a fourth temperature range higher than the third temperature range;

when the temperature of the engine falls within the fourth temperature range, the control portion performs a control operation of decreasing the flow rate of the cooling water flowing through the auxiliary device channel, increasing the flow rate of the cooling water flowing through the radiator channel, and increasing an ejection amount of the heater pump as the engine load increases; and the flow control valve restricts the flow rate of the cooling water to a low flow rate in a predetermined initial period after the main channel and the auxiliary device channel are connected to each other by the channel switching valve, and then gradually increases the flow rate of the cooling water to a predetermined flow rate.

* * * * *